US009273458B2

(12) United States Patent
Davis et al.

(10) Patent No.: US 9,273,458 B2
(45) Date of Patent: Mar. 1, 2016

(54) WIDE SPAN STATIC STRUCTURE

(75) Inventors: Arnold A. Davis, Pittsburgh, PA (US); George Abdel-Sayed, Bloomfield Hills, MI (US); Kenneth F. Lee, Highlands Ranch, CO (US); Gary J. Bonacci, Burgettstown, PA (US); Matt Helgeson, Allison Park, PA (US); Jeffrey P. Metropolis, Pittsburgh, PA (US); Phillip Ostrowski, Munhall, PA (US)

(73) Assignee: King Solomon Creative Enterprises Corp., McKees Rocks, PA (US)

( * ) Notice: Subject to any disclaimer, the term of this patent is extended or adjusted under 35 U.S.C. 154(b) by 0 days.

(21) Appl. No.: 13/529,565

(22) Filed: Jun. 21, 2012

(65) Prior Publication Data

US 2013/0042568 A1 Feb. 21, 2013

Related U.S. Application Data

(60) Provisional application No. 61/525,043, filed on Aug. 18, 2011.

(51) Int. Cl.

| | |
|---|---|
| ***E04C 1/00*** | (2006.01) |
| ***E04B 1/00*** | (2006.01) |
| ***E04B 1/342*** | (2006.01) |
| ***E04B 1/24*** | (2006.01) |
| ***E04C 3/09*** | (2006.01) |
| ***E04C 3/32*** | (2006.01) |

(Continued)

(52) U.S. Cl.

CPC . *E04B 1/342* (2013.01); *E04B 1/24* (2013.01); *E04C 3/09* (2013.01); *E04C 3/32* (2013.01); *E04C 3/40* (2013.01); *E04B 2001/2415* (2013.01); *E04B 2001/2448* (2013.01); *E04B 2001/2472* (2013.01); *E04B 2001/2481* (2013.01); *E04B 2001/2487* (2013.01); *E04B 2001/2493* (2013.01); *E04B 2001/2496* (2013.01); *E04C 2003/0491* (2013.01); *E04C 2003/0495* (2013.01)

(58) Field of Classification Search

CPC ..... E04B 1/342; E04B 1/3205; E04B 1/32; E04B 2001/3235; E04B 2001/2493; E04B 2001/2472; E04B 7/10; E04B 7/08

USPC ..... 52/80.2, 80.1, 86, 644, 671, 653.1

See application file for complete search history.

(56) References Cited

U.S. PATENT DOCUMENTS 1,817,619 A * 8/1931 Greenwald ..... 52/31
2,558,946 A * 7/1951 Fromson ..... 52/335

(Continued)

FOREIGN PATENT DOCUMENTS

FR 1437594 A 5/1966
FR 2096625 A2 2/1972
JP 05071105 A * 3/1993 ..... E01D 15/12

OTHER PUBLICATIONS

Behlen Industries LP Manual: CORR-SPAN® Building System, Jan. 2005, Vr. 1.0.

(Continued)

*Primary Examiner* — Christine T Cajilig
(74) *Attorney, Agent, or Firm* — Fish & Richardson P.C.

(57) ABSTRACT

A building structure includes an upper chord element, a lower chord element and web elements extending between the upper chord element and the lower chord element. The upper chord element forms part of an outer surface of a roof for the building structure.

45 Claims, 23 Drawing Sheets

(51) Int. Cl.
*E04C 3/40* (2006.01)
*E04C 3/04* (2006.01)

(56) References Cited

U.S. PATENT DOCUMENTS 3,064,771 A * 11/1962 Behlen ..... 52/245
3,064,773 A * 11/1962 Linecker ..... 52/521
3,091,313 A 5/1963 Colbath
3,094,813 A * 6/1963 Van Rensselaer ..... 52/344
3,439,459 A * 4/1969 Silberkuhl ..... 52/18
3,449,872 A * 6/1969 Naffa et al. ..... 52/66
3,728,835 A * 4/1973 McManus ..... 52/334
3,748,796 A * 7/1973 Ouellet ..... 52/86
4,056,908 A * 11/1977 McManus ..... 52/334
4,068,442 A * 1/1978 Troutner ..... 52/693
4,195,454 A * 4/1980 Sauder ..... 52/92.1
4,241,553 A * 12/1980 Reicherts et al. ..... 52/309.5
4,282,619 A * 8/1981 Rooney ..... 14/6
4,586,307 A * 5/1986 Fiergolla et al. ..... 52/334
4,876,828 A * 10/1989 Brill ..... 52/23
5,069,008 A * 12/1991 Ellen ..... 52/80.2
5,251,412 A * 10/1993 de Almeida Borges ..... 52/109
5,269,106 A * 12/1993 Stafford et al. ..... 52/63
5,784,842 A 7/1998 Wackerbauer
2001/0023561 A1 * 9/2001 Henbid et al. ..... 52/222

OTHER PUBLICATIONS

CORR-SPAN® Building System, System Details by Behlen Industries LP, Downloaded Jul. 1, 2009.
CORR-SPAN® Building System Comparison with FLEX-SYS® Building System by Behlen Industries LP, Downloaded Jul. 1, 2009.
Behlen Industries LP, Building Value With Steel®—CORR-SPAN ® and FLEX-SYS® Building Systems, Downloaded Jul. 1, 2009.
Extended European Search Report which issued on Dec. 16, 2014 in corresponding European Patent Application No. 12824511.5.

* cited by examiner

WIDE SPAN STATIC STRUCTURE

TECHNICAL FIELD

This invention relates to static structures, and more particularly to wide span static structures.

BACKGROUND

Pre-engineered metal buildings often serve as a cost effective solution for both commercial and residential applications. Traditionally, such buildings or structures employ thin metal panels for both the wall and roofing constructions. The thin metal panels are usually preferable because they can be readily fabricated at relatively low cost. Integrity of these static structures is frequently the most pressing engineering concern. As such, static structures or buildings employing these thin metal panels and spanning more than about 50 feet in width are provided with intermediate support columns or beams dividing the overall span of the structures into discrete sections that can be more soundly supported. While the support columns are preferable for engineering concerns, they are often unsightly and can cause space concerns for consumers (for example, in aircraft hangers).

SUMMARY

One aspect of the present invention features a building structure with an upper chord element, a lower chord element and a plurality of web elements extending between the upper chord element and the lower chord element. The upper chord element forms part of an outer surface of a roof for the building structure. A typical building would include many of these building structures arranged side-by-side and connected to one another. In that case, the upper chord elements would collectively form the entire outer surface of the building's roof.

In a typical implementation of the present invention, the building structure includes a first connecting panel connected to a first end of the upper chord element. The first connecting panel can be curved. Also typically, the building structure has a first side wall panel that is connected to a first end of the first connecting panel and extending to a floor of the building structure. The first side wall panel forms part of a first side wall of the building structure.

In a typical embodiment, the upper chord element is configured to engage, in a substantially weather-proof manner, an adjacent structural element (e.g., another upper chord element or a connecting panel) having a similar shape as the upper chord element. In such instances, the upper chord element and the adjacent structural element cooperatively form a section of the outer surface of the roof for the building structure.

Certain implementations include a second connecting panel connected to a second end of the upper chord element. In general, the second connecting panel can be curved.

According to some embodiments, the building structure further includes a second side wall panel connected to a second end of the second connecting panel and extending to the floor of the building structure. In such instances, the second side wall panel forms part of a second side wall of the building structure.

In some embodiments, the distance between the first side wall panel and the second side wall panel is greater than 50 feet and less than 120 feet. Additionally, in a typical implementation, this distance is achieved without intermediate structural elements that extend from the building structure to the floor between the first side wall panel and the second side wall panel.

The composite arch-truss roof and side wall systems may be also applied with intermediate supports. In this case the roof system will be continuous over the columns and no limits will be imposed on the total width of the building.

The first side wall panel and the second side wall panel can extend, for example, from the first connecting panel and the second connecting panel, respectively, toward the floor at an outward angle relative to plumb. In some instances, the outward angle is between about 8 degrees and 15 degrees.

Some embodiments include a stiffening member coupled to the first side wall panel. The stiffening member can be a structural element selected from the group consisting of a c-channel, an arrangement including back-to-back c-channels, an I-beam, a beam with a rectangular cross-section, a beam with an l-shaped cross-section, and an H-beam. Other cross-sections are possible as well.

In certain implementations, the side wall panels and the upper chord element have a substantially flat central segment, a pair of inclined side segments that extend from opposite ends of the substantially flat central segment, respectively and a pair of flanges, each of which extends from a distal end of one of the inclined side segments. The pair of flanges sometimes lie in a plane that is substantially horizontal to the substantially flat central segment.

The upper chord element and the side wall panels, in some instances, further include a stiffener in the form of a channel in the substantially flat central segment. The stiffener channel can have a width between about 0.75 inches and about 1.25 inches (including, for example, between about 0.8 inches and about 1.2 inches, about 0.9 inches and about 1.1 inches, etc.). Moreover, the stiffener channel can have a depth between about 0.25 inches and about 0.375 inches (including, for example, 0.3 inches).

According to some implementations, the upper chord element further includes: a pair of overhanging lips coupled to distal ends of each respective flange. Each overhanging lip can be angled relative to an adjacent one of the flanges in an opposite direction than a corresponding one of the inclined side walls.

In a typical embodiment, the upper chord element, the first connecting plate and the first side wall plate have substantially similar cross-sections and are joined (e.g., with bolts) to form a continuous structure.

In a typical implementation, the distance across the upper chord element in a lateral direction is between about 24.5 inches and about 49.0 inches.

The web elements can include diagonal members and one or more substantially "vertical" members that extend from a point on the upper chord element along a shortest path to the lower chord element.

The connection between each diagonal element and the upper chord element can be provided by one bolt connection.

In some implementations, the building structure includes a bracing system. The bracing system can include one or more longitudinal stiffener members substantially parallel and coupled to the lower chord element (or otherwise coupled to the truss assembly).

In another aspect, a building includes a first building structure with an upper chord element, a lower chord element and web elements that extend between the upper chord element and the lower chord element; and a second building structure adjacent the first building structure. The second building structure has a structural element, which may be substantially identical (at least in part) to the first building structure and may be configured to engage the upper chord element of the first building structure in a substantially weatherproof manner. The upper chord element of the first building structure and the structural element of the second building structure cooperatively form part of an outer surface of a roof for the building.

In a typical implementation, a series of upper chord elements and structural elements cooperatively for, the outer surface of the roof of the building.

According to some embodiments, the building also has a first connecting panel and a second connecting panel. Typically, the first connecting panel is connected to the upper chord element of the first building structure and the second connecting panel is connected to the structural element of the second building structure. The first connecting panel and the second connecting panel can be curved.

Certain implementations include a first side wall panel connected to first connecting panel; and a second side wall panel connected to the second connecting panel. In such instances, the first side wall panel and the second side wall panel cooperatively form part of a first side wall of the building.

The upper chord element of the first building structure can be configured to engage, in a substantially weather-proof manner, the structural element of the second building structure. The structural element of the second building structure typically has a substantially similar shape as the upper chord element of the first building structure, and the upper chord element of the first building structure. The structural element of the second building structure cooperatively forms part of the outer surface of the roof for the building.

Some embodiments include a third connecting panel connected to the upper chord element at an opposite end of the upper chord element from the first connecting panel and a fourth connecting panel connected to the structural element at an opposite end of the structural element from the second connecting panel. The third and fourth connecting panels typically are curved.

Some embodiments include a third side wall panel connected to third connecting panel and a fourth side wall panel connected to the fourth connecting panel. The third side wall panel and the fourth side wall panel cooperatively form part of a second side wall of the building.

The first side wall panel and the second side wall panel can be a distance from the third side wall panel and the fourth side wall panel that is greater than 50 feet and less than 120 feet without intermediate structural elements that extend from the building to the floor between the first side wall panel and the second side wall panel on one hand and the third side wall panel and the fourth side wall panel on another hand.

The first side wall panel and the second side wall panel can, in some embodiments, extend from the first connecting panel and the second connecting panel, respectively, toward the floor at a first outward angle relative to plumb. In such instances, the third side wall panel and the fourth side wall panel extend from the third connecting panel and the fourth connecting panel, respectively, toward the floor at a second outward angle relative to plumb. The first outward angle and the second outward angle are between about 8 degrees and 15 degrees.

Some implementations include a stiffening member coupled to one or more of the first side wall panel, the second side wall panel, the third side wall panel and the fourth side wall panel. The stiffening member can be a structural element selected from the group consisting of a c-channel, an arrangement including back-to-back c-channels, an I-beam, a beam with a rectangular cross-section, a beam with an l-shaped cross-section, and an H-beam.

Each of the upper chord element and the structural element can include a substantially flat central segment, a pair of inclined side segments that extend from opposite ends of the substantially flat central segment, respectively and a pair of flanges, wherein each flange extends from a distal end of one of the inclined side segments. The pair of flanges can lie in a plane that is substantially horizontal to the substantially flat central segment.

In certain instances, each of the upper chord element and the structural element further can include a stiffening channel in the substantially flat central segment. The stiffening channel typically has a width between about 0.75 inches and about 1.25 inches, and a depth between about 0.25 inches and about 0.375 inches.

According to certain embodiments, each of the upper chord element and structural element further has a pair of overhanging lips coupled to distal ends of each respective flange. Each overhanging lip is angled relative to an adjacent one of the flanges in an opposite direction than a corresponding one of the inclined side walls.

In certain instances, each of the upper chord element, the first connecting plate, the third connecting plate, the first side wall plate and the third side wall plate have substantially similar cross-sections and are joined to form a continuous structure. Moreover, in certain instances, each of the structural element, the second connecting plate, the fourth connecting plate, the second side wall plate and the fourth side wall plate have substantially similar cross-sections and are joined to form a continuous structure.

Certain implementations include a spacer member connected between one of the flanges of the upper chord element and one of the flanges of the structural element.

The plurality of web elements can include diagonal members and one or more members that extend from a point on the upper chord element along a shortest path to the lower chord element.

The building, in some embodiments, has a bracing system comprising a plurality of longitudinal stiffener members substantially parallel and coupled to the lower chord element.

In some implementations, one or more of the following advantages are present.

For example, a structurally simple, easy-to manufacture building can be produced. The building can have a very wide span (e.g., 50 feet or more and in some instances up to 120 feet or more). This wide-span static structure has good structural integrity as well and provides a large area of usable, uninterrupted floor space.

References to an outer surface of a building's roof, and the like, herein generally refer to the outer surface of a completed building. Thus, in a typical implementations, no additional layers of roofing material would need to be placed above this outer surface of the roof's building to produce a completed and usable roof or building.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings can indicate like elements.

DETAILED DESCRIPTION

Figure 1:
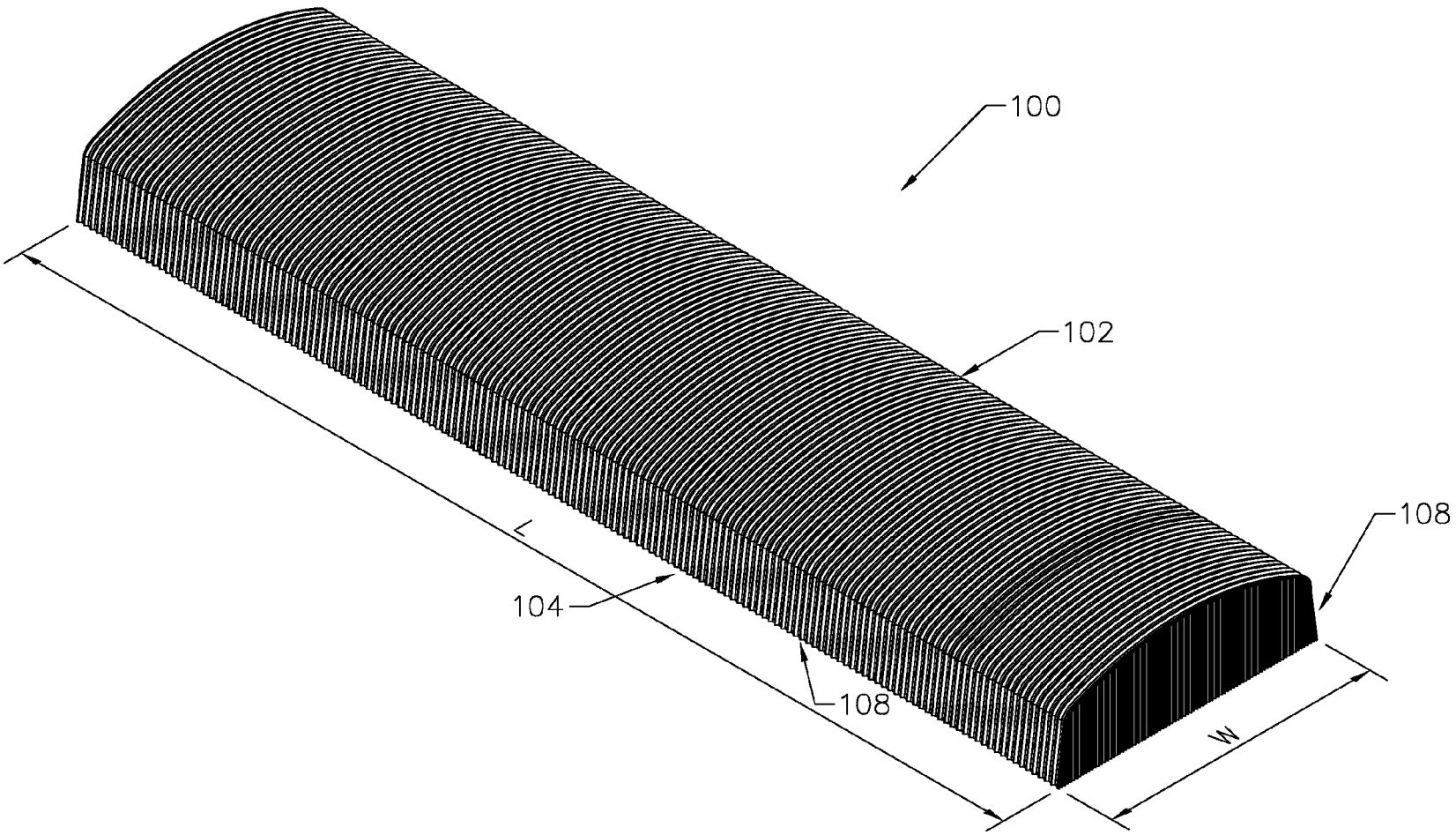
FIG. 1 is a perspective view of a static structure having a free-span roof.
Figure 2:
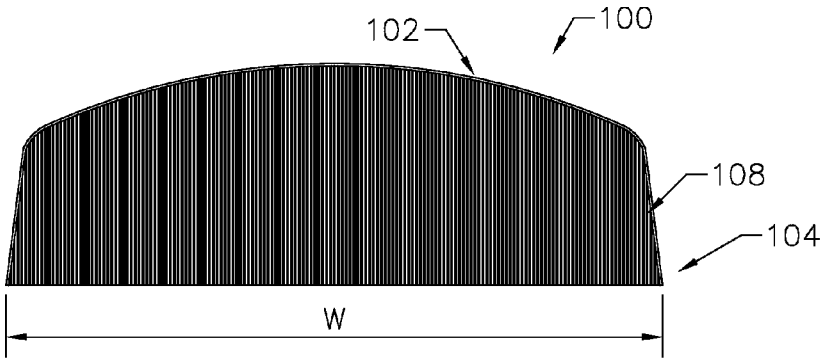
FIG. 2 is front view of the static structure of FIG. 1.
Figure 3:
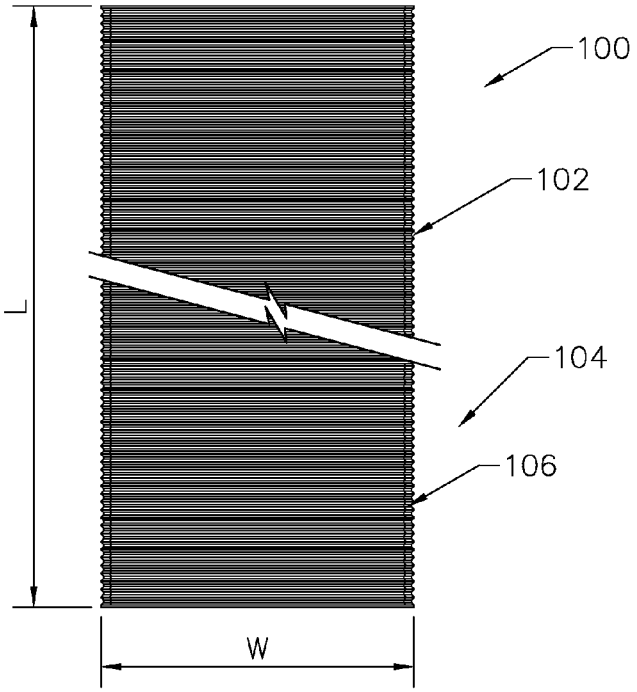
FIG. 3 is a top view of the static structure of FIG. 1.
Figure 4:
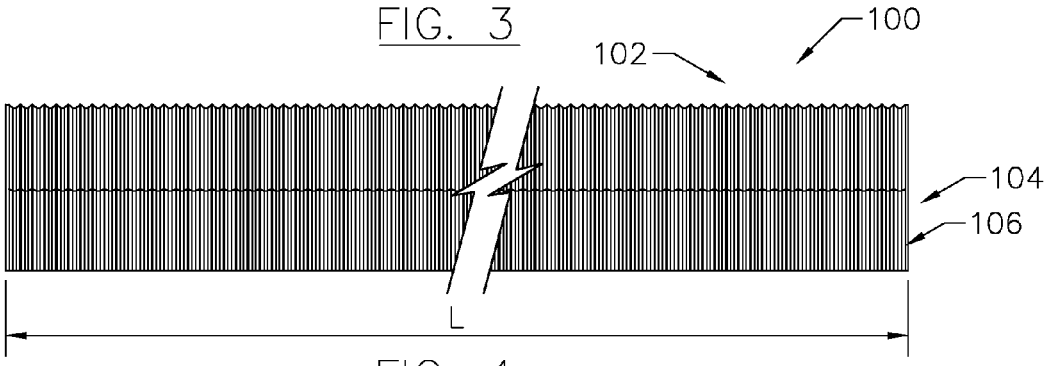
FIG. 4 is a side view of the static structure of FIG. 1.

Most steel frame buildings are constructed for commercial use. Thus, appearance is less important than, construction economy, strength and durability of construction materials. The objective is to provide a building that offers maximum useable floor space, at low cost. It is well known to build wide span steel buildings. However, if the use of roof support members such as stanchions or the like is to be avoided, the building must be constructed using thick, heavy gauge metal materials. This necessarily increases the cost of materials and the expense of construction. Wide span buildings can be constructed with lighter gauge metals as a cost saving measure, but this requires the use of internal support members such as stanchions or the like. Absent such support, the wind loading and snow loading capabilities of the building are seriously compromised. If such internal support members are employed, they necessarily reduce the useable interior floor space. A further drawback to such vertical support members is that they often preclude use of the building for certain applications, such as airplane hangars or warehouse facilities for large scale products (e.g., industrial power generators or commercial printing equipment). Maneuvering such products between support stanchions is difficult and often leads to damage of the building or the product being moved within the building. Thus, the metal building construction field has sought a wide span building arrangement that could be constructed using light gauge metal, such as 23 GA up to 16 GA.

The present invention provides a static structure made of light gauge metal that includes a free span roof assembly. The roof assembly may be provided in the form of a plurality of interconnected thin metal panels each establishing a top chord of a supporting truss. Each thin metal roof panel may be configured to receive a load and to distribute the load to members of the supporting truss while withstanding combined compression and bending stresses resulting from distributing the load.

Most free standing light gage steel structures are built using panels with a depth of about 7 inches to about 8 inches (e.g., about 7.08 inches). These panels have limited strength and impose a limit on the free span of the building. In contrast, use of panels with deeper depth requires increased steel thickness and, thus becomes more costly. The present disclosure provides an economical wide span building (one that has wide spans up to 100 feet or more between supporting structures such as side walls or stanchions). The added strength of the truss system over the roof area enables the metal frame structure of the present invention to provide improved wind and snow load carrying capacity. The structures constructed according to the present invention take advantage of the dual function of the roof panels, which serve as a roof, carrying lateral loading (wind, snow, etc.), and as the upper chord element of the truss system. Further the walls, which are slightly angled from the vertical, improve the sway resistance and the overall stability of the frame.

The structure of the present invention can employ an arch type or a gable type roof construction. Arches are often selected in order to enable the use of crimped roof panels. Crimping of the panel puts some ridges on the webs and thus enhances their local rigidity, shear strength in shear and their resistance against crippling. The crimping of the panels is made to a large radius. In general, the radius is selected to suit the geometry of the building and to have smooth transfer between the wall-panels, the connecting eave panels and the roof panels.

Such roof assemblies, as described in detail herein, may have improved load carrying capacity and may be provided in longer unsupported spans without compromising their structural integrity, in view of other comparable roof assemblies. Further, the above-mentioned structural advantages can be achieved while limiting the thickness of the roof panels, so as to provide an economic roofing solution for static structures. The invention will be better understood with reference to the following description.

FIGS. 1-4 are a perspective, front, top, and side views of a static structure 100 of the present invention. As shown, static structure 100 includes a roof 102, and a wall 104 coupled to the roof. In this example, roof 102 is provided in a free-span configuration (i.e., having no intermediate supporting columns or beams) and includes a plurality of adjacent interconnected panels each spanning the structure's width, as discussed in further detail below. Roof 102 shields or covers a defined spaced enclosed by wall 104. Wall 104 includes side walls 106, which define a length "L" of static structure 100, and end walls 108, which define a width "W". Static structure 100 may be constructed to have any suitable length and/or width. For example, a suitable width may be considered the maximum free span that can be achieved by the panels of roof 102 without failure under expected loads (or any width less than the maximum). In some implementations, a suitable width of static structure 100 may be considered any width up to about 120 feet. Additionally, in some examples, the structural integrity of the static structure may not be influenced by its length. As such, any desired length may be considered a suitable one.

Figures 5A, 5B, 5C:
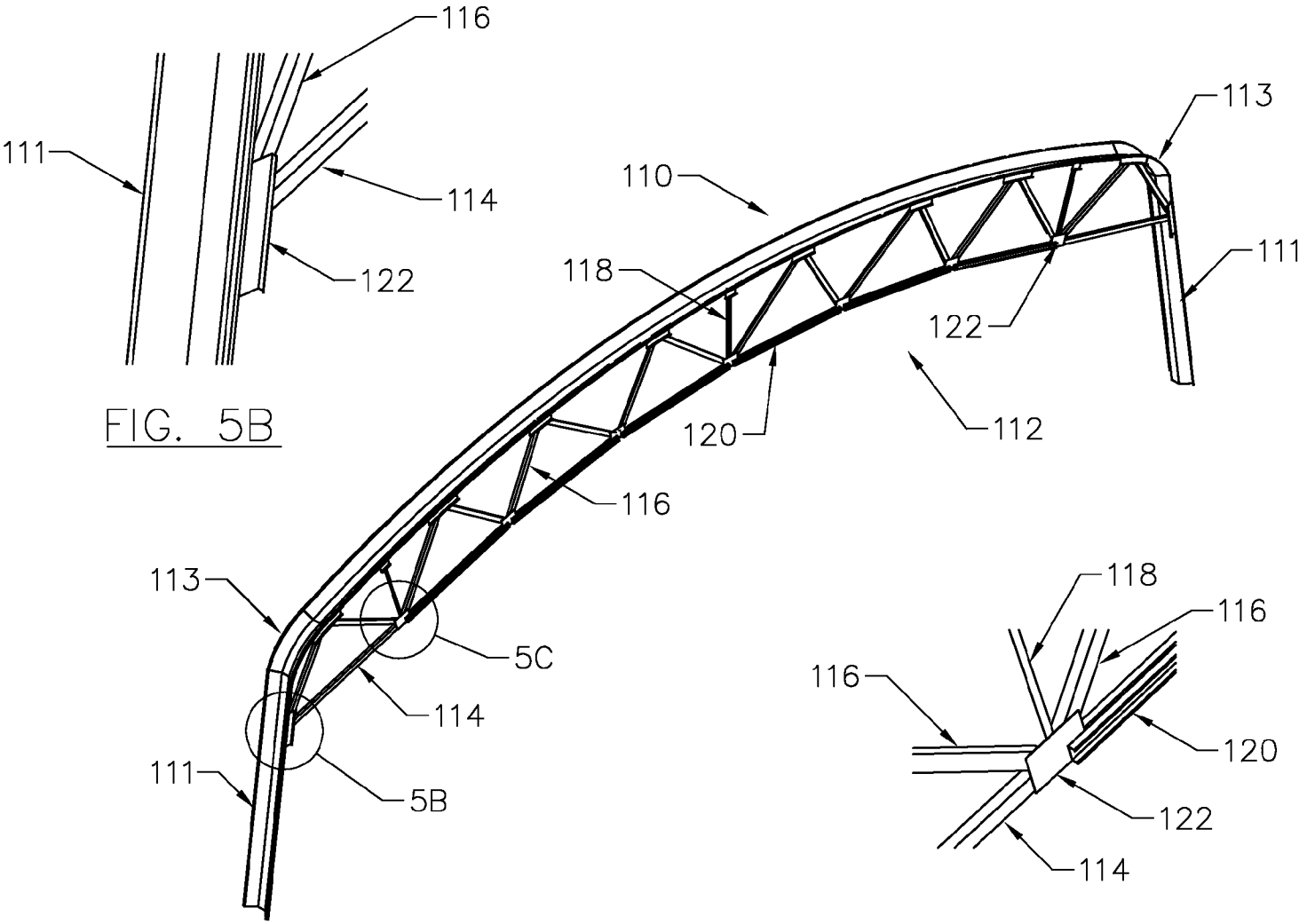
FIG. 5A is a perspective view of a free-span roof panel and a supporting truss assembly.
FIG. 5B is a detailed perspective view of a first joint shown in FIG. 5A.
FIG. 5C is a detailed perspective view of a second joint shown in FIG. 5A.

FIG. 5A is a perspective view of a free-span roof panel 110 and a supporting truss assembly 112. Side wall panels 111 and connecting panels 113 coupling roof panel 110 to the side walls are also shown. In this example, roof panel 110 is provided in the form of a corrugated, arch type roof panel. In alternative examples, however, other suitable types of roof paneling may be used (e.g., gable type roof paneling, etc.). In some examples, roof panel 110 is provided in the form of a thin cold rolled metal sheet form construction. For instance, roof panel 110 can be made of steel or steel alloy sheeting coated with a corrosion resistant substance (e.g., ASTM A792, SS Grade 50 to 80, AZ55 Aluminum-Zinc alloy coated), and having a nominal thickness between about 0.027 inches and 0.06 inches.

As shown in FIG. 5A, the top portion of roof panel 110 establishes a top chord of truss assembly 112. As a result, roof panel 110 can perform as both a traditional roof component by directly carrying loads on its outer surface (e.g., wind loads, snow loads, etc.), and as the top chord of truss assembly 112 by distributing the carried loads to other truss members and carrying combined compression and bending stresses. In this way, the dead load (i.e., permanent loads that are constantly imparted on the truss assembly, e.g., the weight of the truss itself, sheathing, roofing, ceiling, etc.) of the assembly is reduced by supplanting a large component of traditional roof truss assemblies with a suitable thin metal roof panel 110 (manufacturing costs may also be reduced as a result).

Truss assembly 112 includes bottom chord 114, webs 116 (e.g., haunches and diagonal members), braces 118, and stiffeners 120 which are interconnected to one another, as well as other members of static structure 100 at a plurality joints via gusset plates 122. FIGS. 5B and 5C provide detailed views of two such joints. Bottom chord 114 establishes the lower edge of truss assembly 112 and is configured to carry tension or compression forces. Webs 116 run between roof panel 110 and bottom chord 114 forming triangular patterns for distributing both dead and live loads. Webs 116 are configured to carry tension or compression loads (usually not bending stresses). In this example, each of webs 116 is positioned at an angle between about 40° and 48° (preferably 45°) with respect to bottom chord 114. Webs 116, however, may be positioned at any suitable angle with respect to bottom chord 114 or roof panel 110. Further, in some implementations, each of webs 116 may be positioned at a different angle, thereby forming a truss assembly carrying non-uniformly distributed loads. Braces 118 are positioned at right angles with respect to bottom chord 114 in order to resist any lateral movement of the chords or webs under applied loads. Stiffeners 120 run parallel to bottom chord 114 and are coupled to the bottom chord via gusset plates 122.

Figure 6:
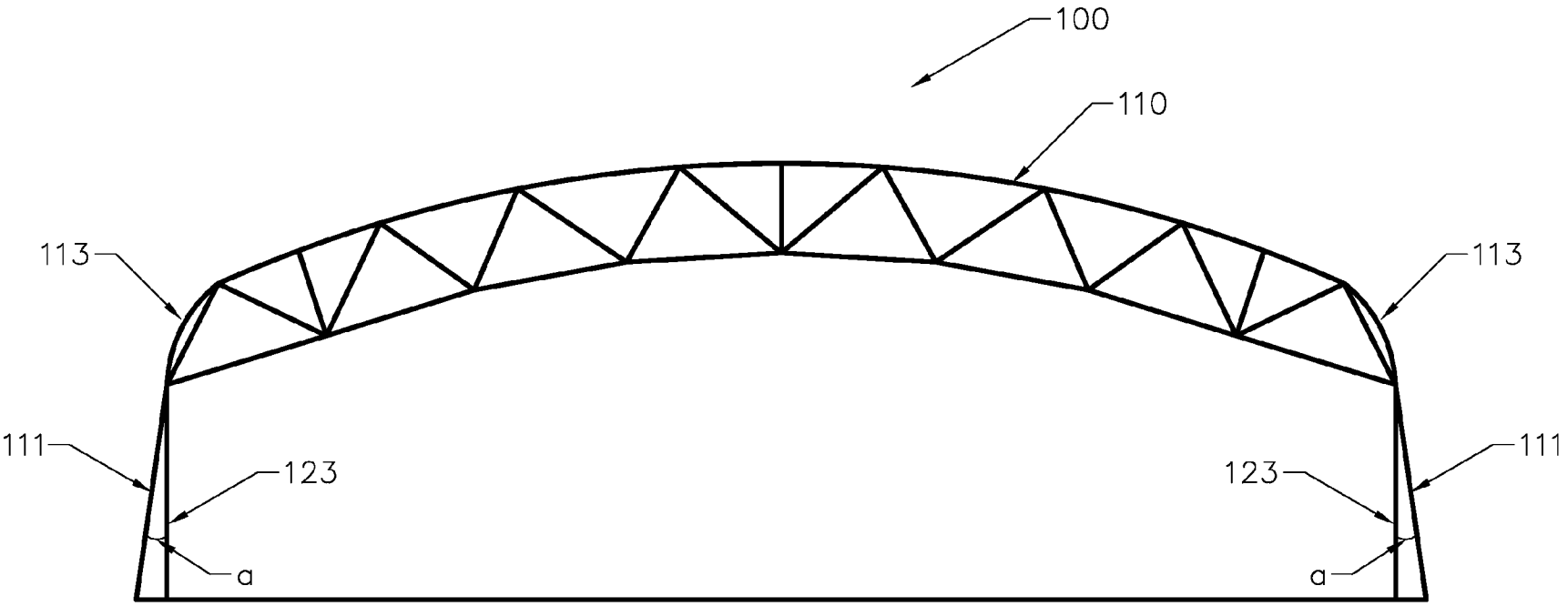
FIG. 6 is a partial cross-sectioned side view of the static structure of FIG. 1.

FIG. 6 is a cross-sectioned side view of static structure 100 providing a schematic perspective of the components described referring to FIGS. 5A-5C. As shown, side wall panels 111 extend outward from connecting panels 113 at an angle "α" from a vertical plane 123. Side wall panels 111 may be extended outward by any suitable angle "α", which may be determined based on expected loads (e.g., expected wind loads) which are computed using tables and calculations well known to those in the construction field. In some implementations, angle "α" is between about 8 and 15 degrees and, preferably, about 8 degrees. For instance, in this example, side wall panels 111 are extended outward at an angle of about 8°. In some cases, the outward slope of the wall panels may increase the integrity of static structure 100 by mitigating the bending moments induced by wind loading (compared to plumb vertical walls). The following table provides comparative results of a structural frame analysis determining the maximum bending moments induced for two similar buildings (such as static structure 100) enduring 90 mph wind speeds:

| | Building with Plumb Vertical Walls | Building with Angled Walls |
|---|---|---|
| Positive Maximum Bending Moment | +99.1 kip. in/frame | +76.75 kip. in/frame |
| Negative Maximum Bending Moment | −35.05 kip. in/frame | −31.33 kip. in/frame |

In some cases, providing slightly angled wall panels may also result in a reduction in side sway (quantified herein as horizontal displacement). For example a building with a plumb vertical walls subjected to a horizontal force of 1000 lb. at the top of its wall may exhibit about 2.97 inches or horizontal displacement (i.e., side sway). In comparison, a similar building with slightly angled walls, as described above, under identical conditions may exhibit about 2.71 inches of horizontal displacement.

Figure 7A:
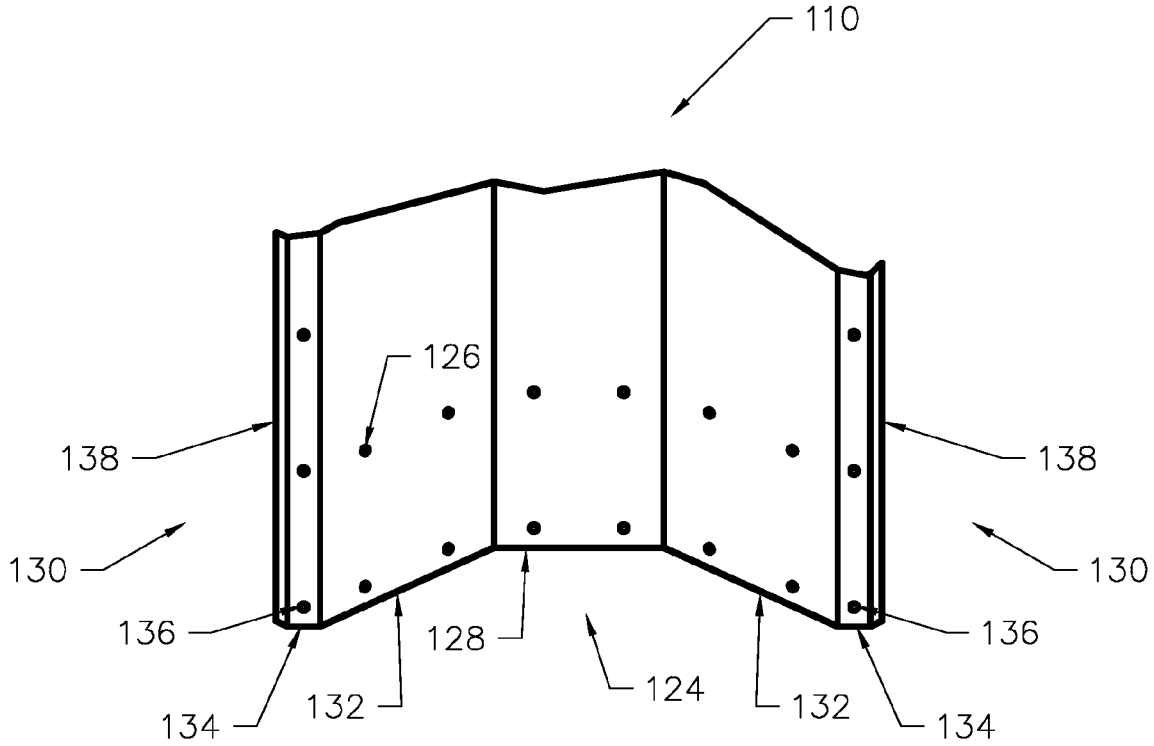
FIG. 7A is a detailed perspective view of part of a free-span roof panel.
Figure 7B:
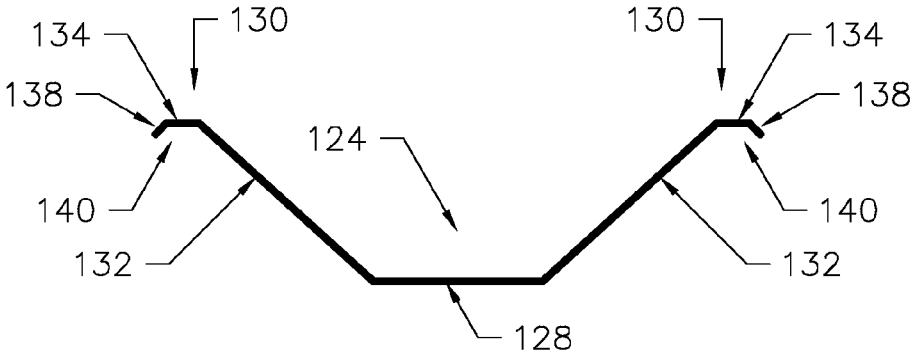
FIG. 7B is a schematic side view of the free-span roof panel of FIG. 7A.

FIG. 7A is a detailed perspective view of roof panel 110 (for clarity, only one end of the roof panel is shown), and FIG. 7B is a schematic side view of the roof panel. As shown, roof panel 110 includes a main body 124 having opposite faces defining its thickness, and two peripheral connector arms 130 disposed on either side of the main body. Main body 124 includes apertures 126 arranged on its ends for receiving mechanical fasteners to secure roof panel 110 to a corresponding connecting panel (e.g., connecting panel 113).

Main body 124 may have any suitable profile. For instance, in this example, main body 124 is provided in the form of a V-beam corrugation having a central segment 128 and two inclined side walls 132 extending outwardly from either side of the central segment at a selected angle of incline. In combination, the profile configuration, thickness, and length of roof panel 110 define a slenderness ratio for determining the maximum allowable compressive stress that the roof panel can carry without failure (e.g., buckling). The slenderness ratio is expressed as follows:

$$\lambda = L_{eff}/r_g \quad (1)$$

$$r_g = (I/A)^{1/2} \quad (2)$$

where λ is the slenderness ratio, $L_{eff}$ is the effective length of the roof panel, $r_g$ is the radius of gyration of the roof panel, I is the second moment of area of the roof panel, and A is the total cross-section area of the roof panel.

In general, the maximum allowable compressive stress decreases as the slenderness ratio increases. Thus, reducing the slenderness ratio of roof panel 110 may increase the maximum allowable compressive stress of the roof panel.

Further, in some implementations, the profile configuration and thickness of roof panel 110 may be selected or modified to increase the radius of gyration, thereby allowing for an increased effective length without increasing the slenderness ratio (and subsequently reducing the maximum allowable compressive stress).

Connector arms 130 are configured to provide a coupling point for other, adjacent roof panels such that the roof panels can be coupled to one another by mating a connector arm of one panel with that of a neighboring panel. In this example, each of connector arms 130 includes a flange 134 having a pattern of apertures 136 arranged thereon, and an overhanging lip 138 extending from the flange. Flange 134 in conjunction with lip 138 defines a recess 140 for receiving an edge construction (e.g., a connector arm) of an adjacent panel. Adjacent and identical roof panels may be connected to one another by inserting a connector arm 130 of one panel within the recess 140 of another panel, aligning apertures 136 of the panels, and introducing a mechanical fastener (e.g., bolts, rivets, screws, etc.) to the aligned apertures. In some alternate examples, other suitable components or methods for coupling adjacent roof panels are used (e.g., welding, seaming, etc.).

Figure 8A:
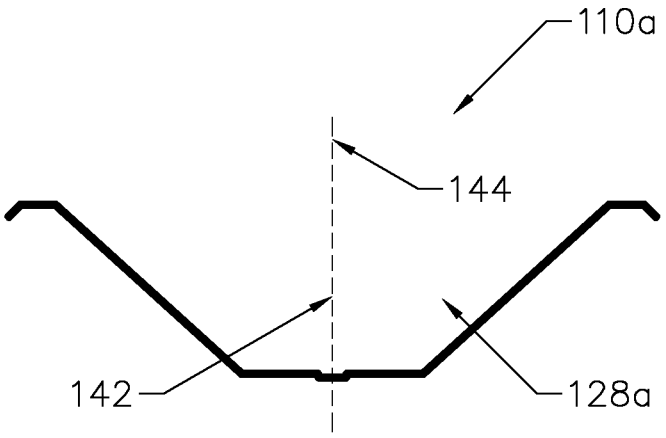
FIG. 8A is a schematic side view of a free-span roof panel having a stiffening element.
Figure 8B:
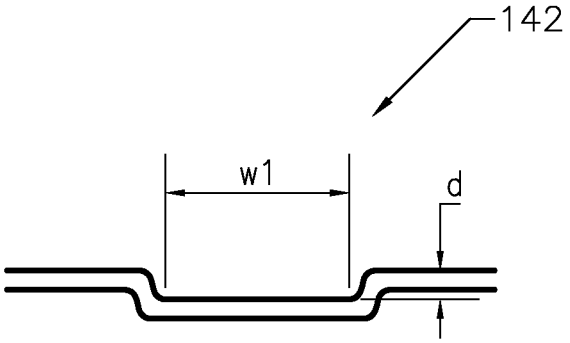
FIG. 8B is a detailed side view of the stiffening element of FIG. 8A.

FIG. 8A is a schematic side view of another example roof panel 110*a*. Roof panel 110*a* is provided in a similar configuration as roof panel 110 (described in detail above). In this example, however, roof panel 110*a* includes a central segment 128*a* having a stiffening formation 142 aligned with a centerline 144. FIG. 8B is a detailed side view of stiffening formation 142. As shown, stiffening formation 142 is provided having a flatbed open channel profile defining an effective width "w1" and a depth "d". In a typical implementation, the stiffener has to have minimum dimensions in order to be effective. In some implementations, width "w1" of stiffening formation 142 is about 1 inch and depth "d" is between about 0.25 inches and 0.375 inches. In some examples, stiffening formation 142 is provided in the form of a continuous lane running along the span of roof panel 110*a*. In some other examples, however, the stiffening formation includes a plurality of discrete beads spaced in a regular or irregular pattern down the roof panel span. Further, in some alternative examples, stiffening formations of other suitable shapes and/or profiles may be used.

The addition of stiffening formation 142 may reduce the width to thickness ratio of the roof panel. As a result, the negative bending strength of the roof panel may increase in magnitude. For example, a roof panel having a thickness of about 0.038 inch without a stiffening formation (e.g., roof panel 110) can be expected to exhibit a nominal bending moment carrying capacity of about −16.2 kip·in/ft., while a similar (e.g., roof panel 110*a*) having an equal thickness and a continuous stiffening formation (e.g., stiffening formation 142 shown in FIGS. 7A and 7B) measuring about 1 inch wide and about 0.25 inches deep can be expected to exhibit a nominal bending moment carrying capacity of about −30.4 kip·in/ft. Thus, a roof panel having a stiffening formation may be less prone to failure (e.g., yielding) under load and can be provided having a longer length, or span without increasing its thickness.

Figure 9A:
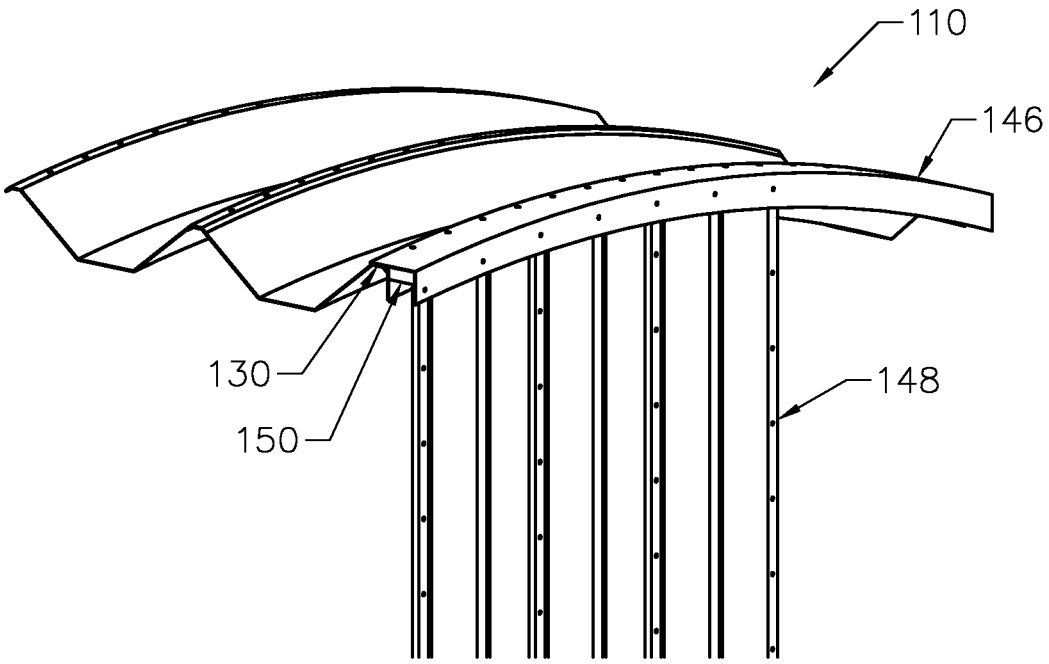
FIG. 9 is a perspective outer view of a coupling between a free-span roof panel and a wall panel.
FIG. 9B is a partial perspective inner view of a roof panel coupled to an end wall of the static structure of FIG. 1.

FIG. 9A is a perspective outer view of a coupling 146 between roof panel 110 and a wall panel 148. Wall panel 148 may have a similar profile to roof panel 110 (see FIGS. 7A and 7B, for example). Further, as shown, coupling 146 is provided in the form of an arched angle having a first end coupled to a connector arm 130 of roof panel 110 and second end, disposed at an angle (approximately 90°) from the first end, coupled to wall panel 148. In this example, a set of mechanical fasteners is used to couple the angle to the roof and wall panels. In some examples, a sealant 150 (e.g., an expanding foam) may be disposed in a space between coupling 146 and wall panel 148. Sealant 150 may inhibit, reduce, or prevent leaking of fluid between the spaced enclosed by static structure 100 and the surrounding environment.

Figure 9B:
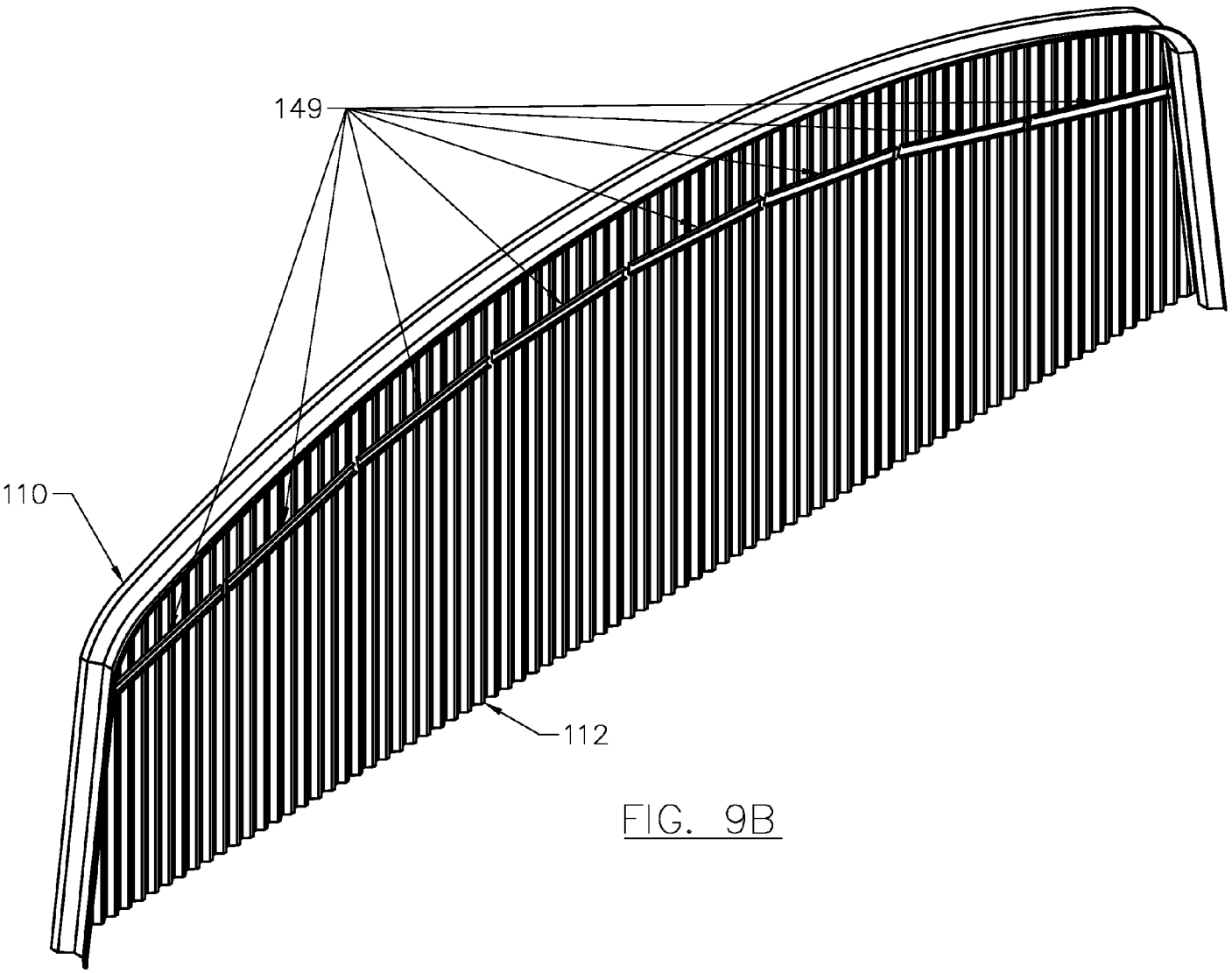

FIG. 9B is a perspective inner view of roof panel 110 and end wall 108 (formed from a plurality of connected wall panels 148). As shown, end wall 108 is braced by stiffener members 149. Stiffener members 149 are coupled to end wall 108 and positioned at the level of the door header or in plane with a bottom chord of a truss assembly (e.g., bottom chord 114 of truss assembly 112).

Figure 10:
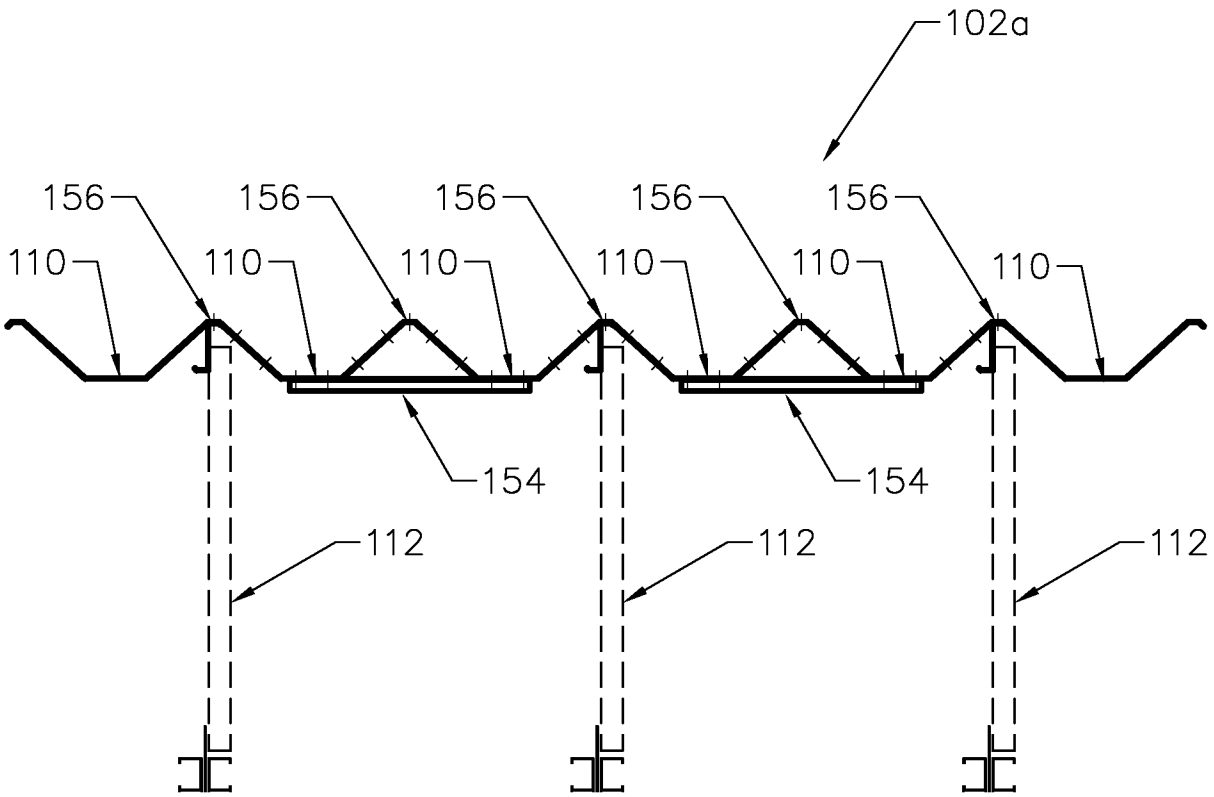
FIG. 10 is a cross-sectioned side view of a roof assembly.

FIG. 10 is a cross-sectioned side view of a roof assembly 102*a* of a static structure. As shown, the roof assembly includes roof panels 110, truss assemblies 112, and spacer members 154. Spacer members 154 are coupled to roof panels 110 and disposed between truss assemblies 112. Each of spacer members 154 may include a single continuous member extending longitudinally along the span of roof panels 110 or a plurality of discrete members positioned intermittently along the panel span. In some examples, spacer members 154 are positioned across a union or splice 156 (e.g., a seam or connection point) between roof panels 110. Truss assemblies 112 may also be positioned proximate panel splices 156 via gusset plates 122, as described in greater detail below, such that each splice is reinforced by a spacer member or a truss assembly in alternating fashion. In this way, each roof panel 110 is supported by a truss assembly 112 on one side and a spacer member 154 on an opposing side. As a result, the structural integrity of the roof assembly is maintained and the roof panels are able to distribute loads without including any redundant truss members or components.

Figure 11A:
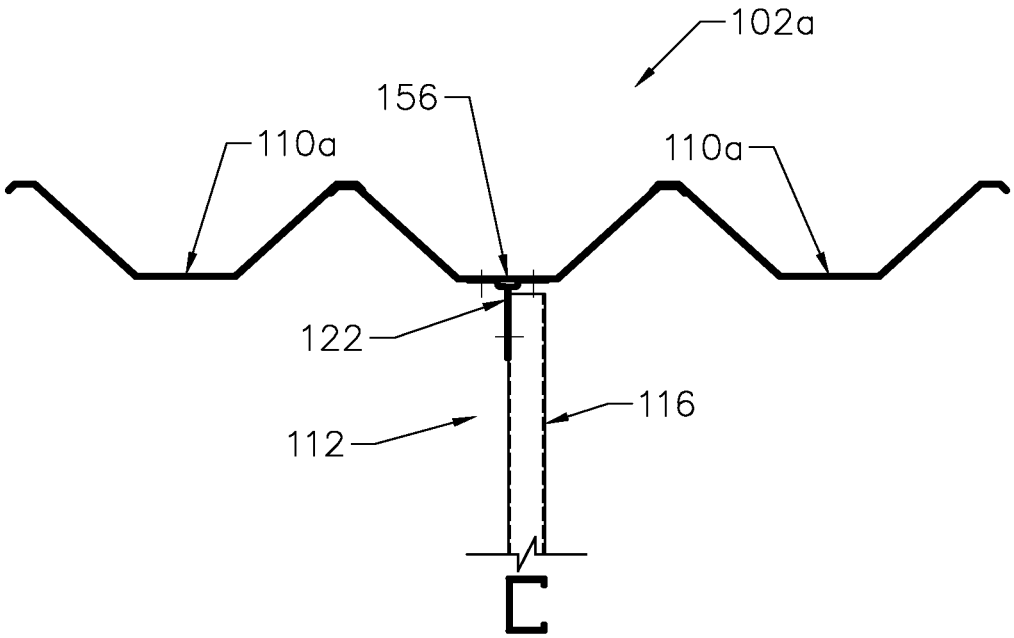
FIG. 11A is a detailed cross-sectioned side view of a splice between roof panels.
Figure 11B:
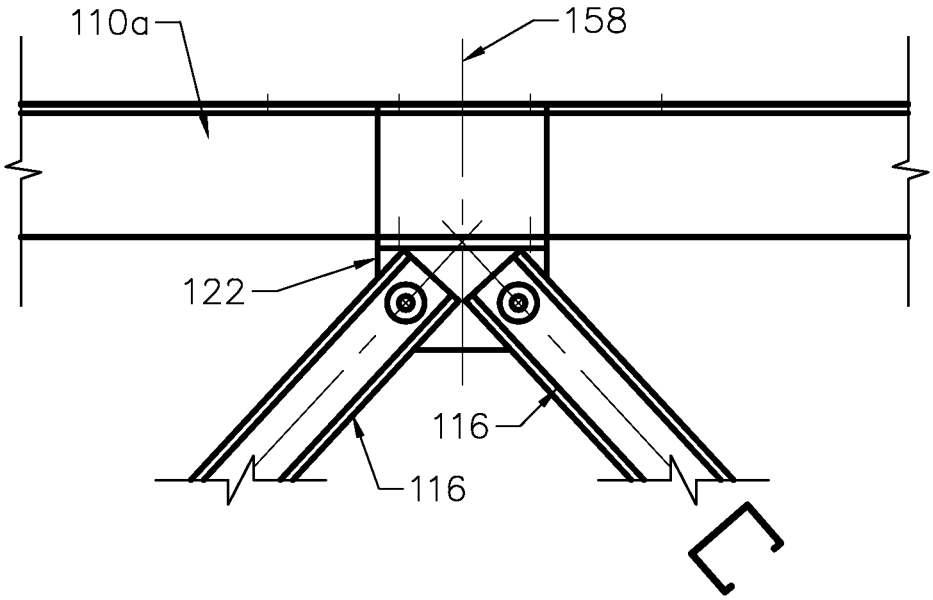
FIG. 11B is cross-sectioned front view of the splice of FIG. 11A.

FIG. 11A is a detailed cross-sectioned view of a splice 156 between roof panels 110*a*. As shown, gusset plate 122 is positioned at splice 156. In this example, gusset plate 122 is integrated into a seam between connector arms of the roof panels. FIG. 11B is cross-sectioned front view of splice 156. In this example, diagonal webs 116 are coupled to gusset plate 122 in mirrored orientations about centerline 158 such that loads carried by roof panels 110*a* can be evenly distributed amongst other members of truss assembly 112.

Figure 12:
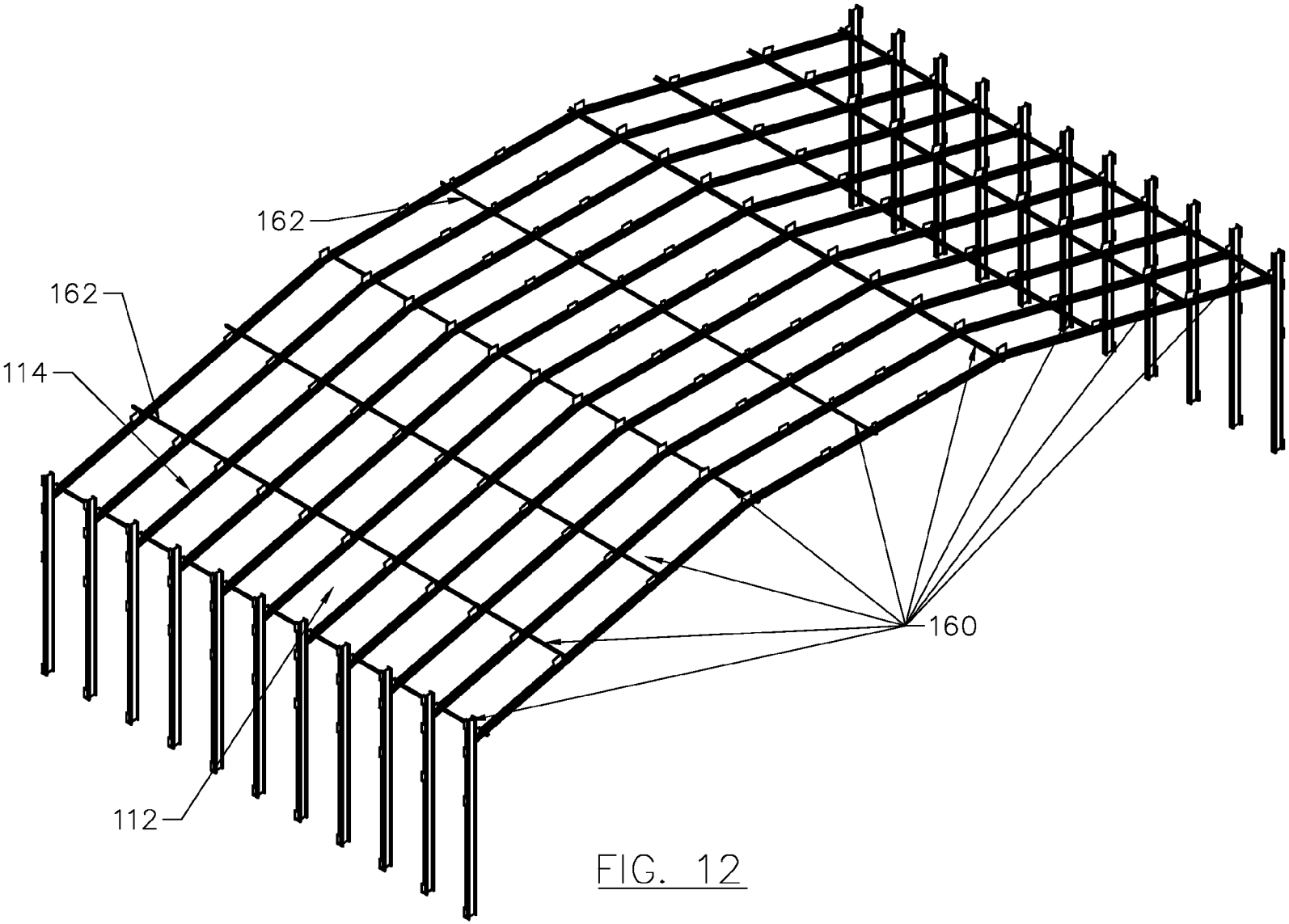
FIG. 12 is a perspective view of a first example bracing system.

FIG. 12 is a perspective view of a first example bracing system 160 coupling the bottom chords 114 of truss assemblies 112 (for clarity, only the bottom chords and bracers of the truss assemblies are shown in conjunction with the bracing system) to one another. The bracing system may strengthen or stabilize truss chords and webs which may be especially long or highly stressed. As shown, bracing system 160 includes a plurality of longitudinal stiffener members 162 spanning across the length of a static structure. Stiffener members 162 may be provided in the form of a single, continuous beam or girder, or a plurality of such members coupled end-to-end. In this example, stiffener members 162 are positioned at the same elevation as bottom chords 114, substantially perpendicular to the planes of truss assemblies 112, and are coupled to the bottom chords. The stiffener members may be provided having any suitable size, shape, or profile for bracing truss assemblies 112.

Figure 13:
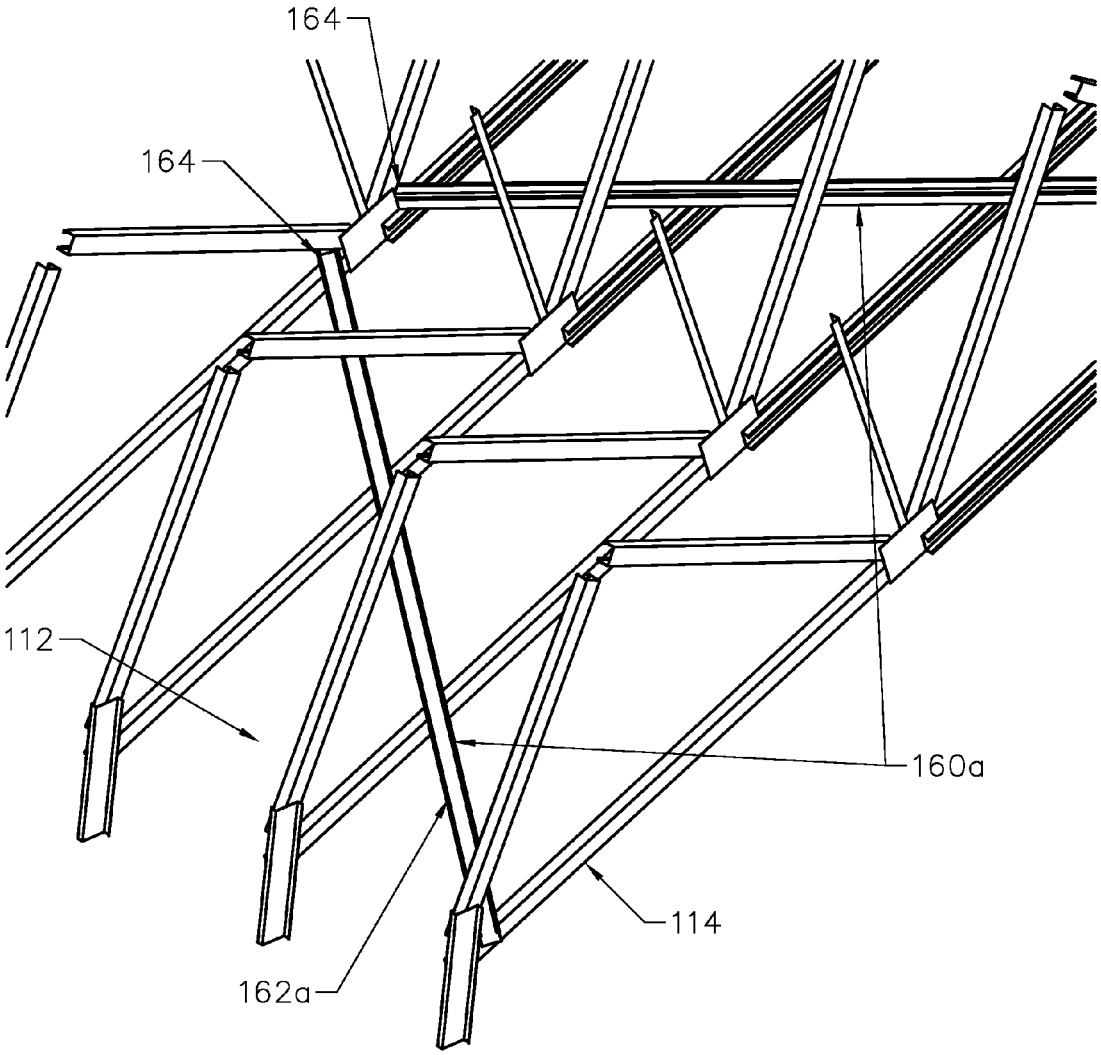
FIG. 13 is a perspective view of a second example bracing system.

FIG. 13 is a perspective view of another exemplary bracing system 160*a* coupled to bottom chords 114 of truss assemblies 112 (for clarity, the top chords of the truss assemblies (i.e., roof panels 110) are not shown). As shown, bracing system 160*a* includes a plurality of diagonal stiffener members 162*a* traversing bottom chords 114 at an angle (e.g., about 45°) on a plane perpendicular to the planes of truss assemblies 112. Stiffener members 162*a* are coupled at their ends 164 to bottom chords 114 and may be coupled to additional bottom chords at points along their length. The stiffener members may be provided having any suitable size, shape, or profile for bracing truss assemblies 112. In some examples, bracing systems 160 and 160*a* are provided in tandem to form a network of stiffening members to facilitate load transferring between truss assemblies 112.

Figure 14A:
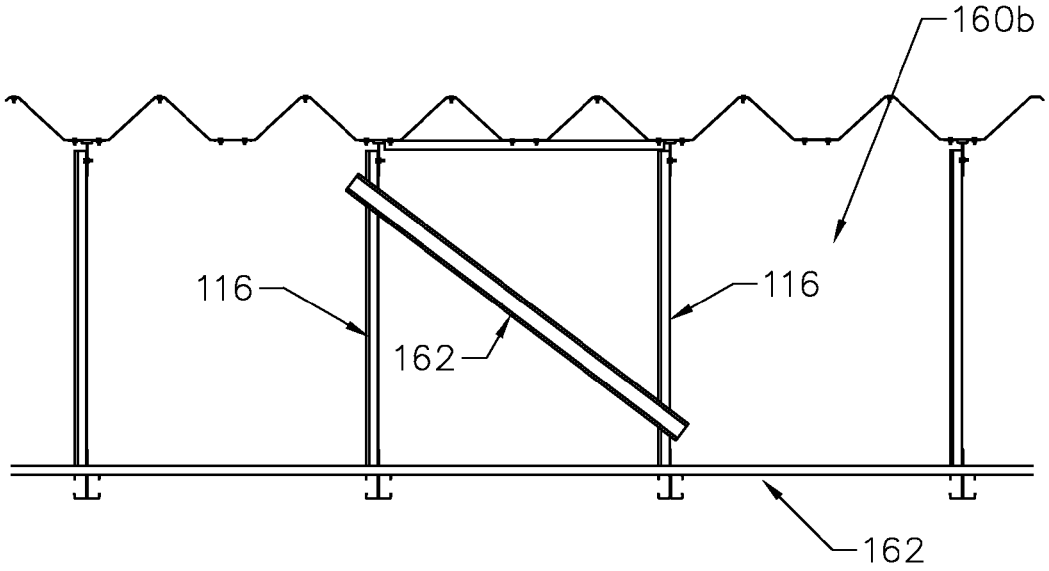
FIG. 14A is a partial front view of another example bracing system.
Figure 14B:
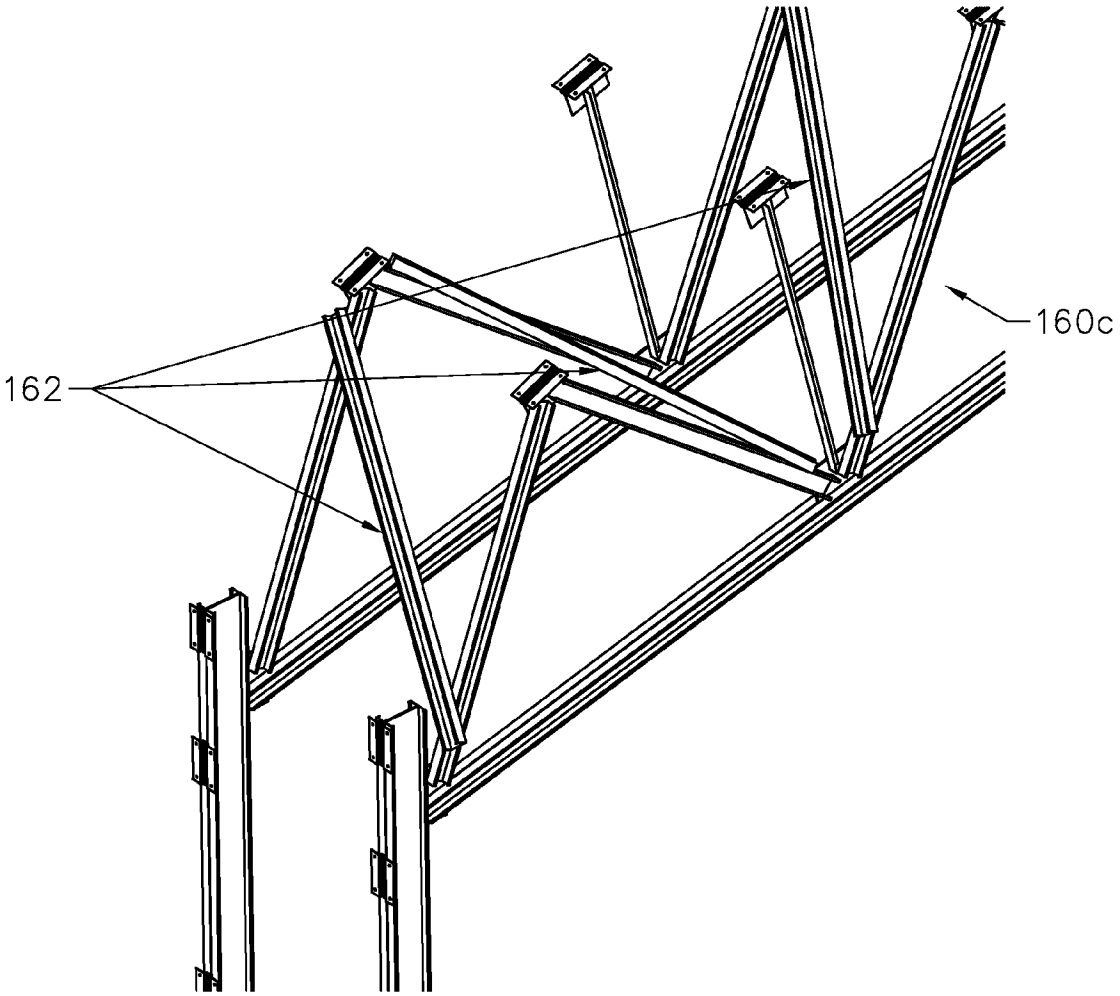
FIG. 14B is a perspective view of the example bracing system in FIG. 14A.

FIG. 14A is a cross-sectional view of yet another bracing system 160*b*; FIG. 14B is a partial perspective view of the bracing system 160*b* of FIG. 14A. The illustrated bracing system 160*b* includes diagonal stiffener members 162*b* that are coupled to adjacent webs 116 of a truss assembly 112. The illustrated stiffener member 162*b* is diagonal by virtue of it being connected to one web 116 near the lower chord element of the truss assembly and being connected to another web 116 near the upper chord element of the truss assembly.

The illustrated bracing system 160*b* also includes a horizontal spacer member 154 that is coupled to the upper chord elements and extends between the upper chord elements of adjacent roof panels.

The illustrated bracing system 160*b* also includes a longitudinal stiffener member 162 that is coupled to the lower chord elements of the truss assembly 112.

Figure 15A:
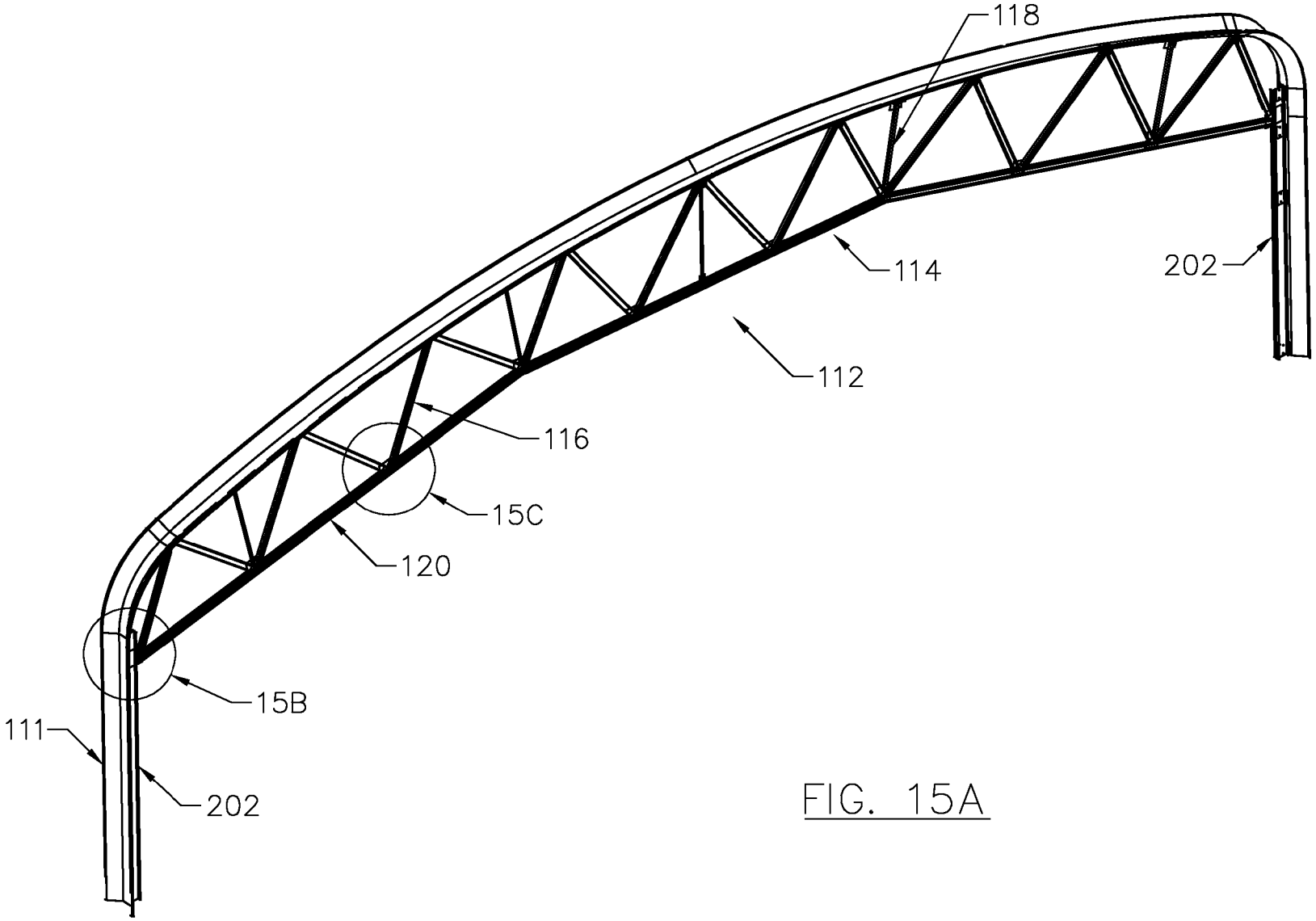
FIG. 15A is a perspective view of a free-span roof panel and a supporting truss assembly.

FIG. 15A is a perspective view of a free-span roof panel 110*a* that is similar to the free-span roof panel 110 in FIG. 5A except that the side wall panels 111 in FIG. 15A are structurally reinforced with a sidewall stiffener 202 and a bottom chord stiffener 120 runs along substantially the entire length of the bottom chord 114 of the truss assembly 112.

Figure 15C:
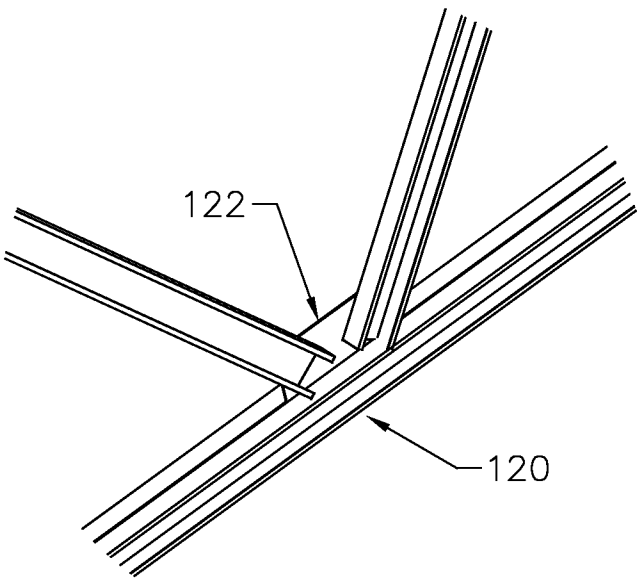
FIG. 15C is a detailed perspective view of a second joint shown in FIG. 15A.
Figure 15B:
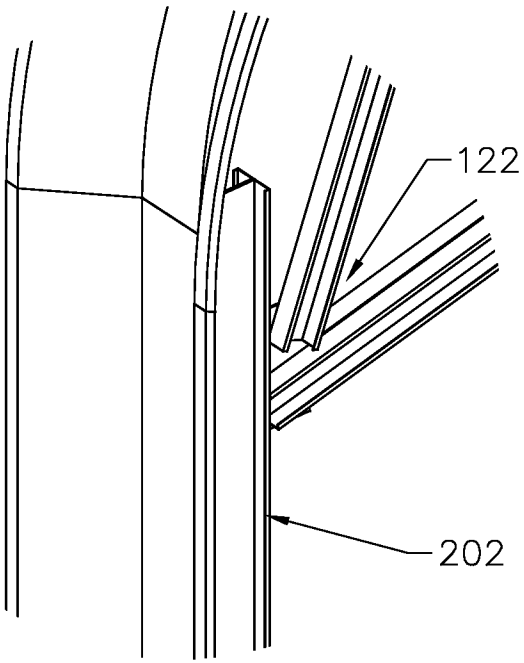
FIG. 15B is a detailed perspective view of a first joint shown in FIG. 15A.

Truss assembly 112 includes bottom chord 114, webs 116 (e.g., haunches and diagonal members), braces 118, and stiffener 120, which are interconnected to one another, as well as other members of static structure 100 at a plurality joints, for example, via gusset plates 122. FIGS. 15B and 15C provide detailed views of two such joints. Bottom chord 114 establishes the lower edge of truss assembly 112 and is configured to carry tension or compression forces.

Figure 16A:
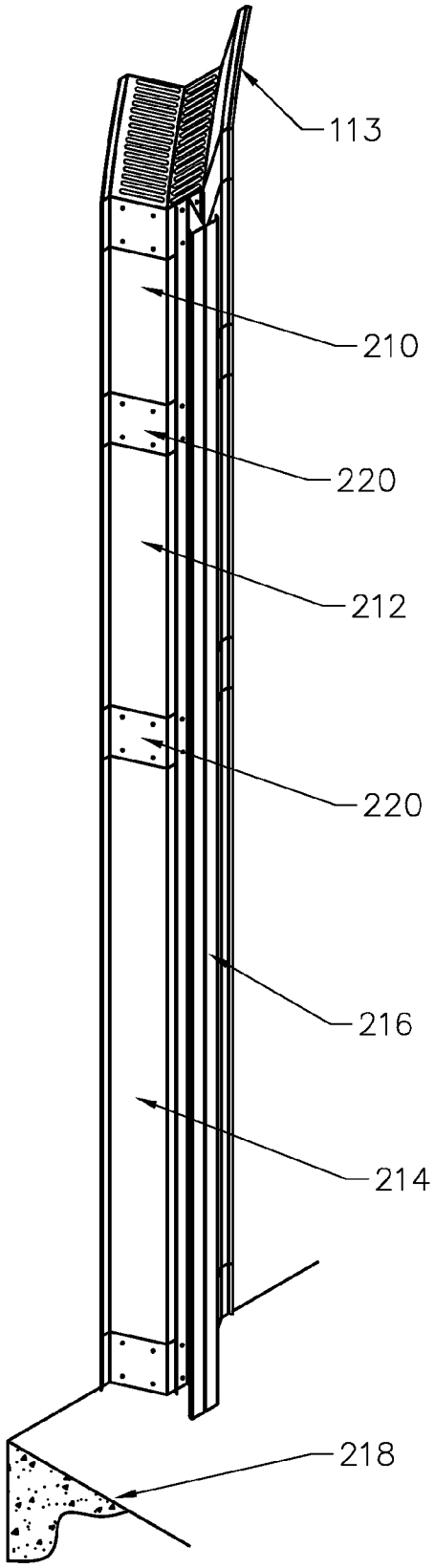
FIG. 16A is a partial perspective view of a reinforced side wall panel.

FIG. 16A is a partial perspective view of a side wall panel 111 with structural reinforcement in the form of back-to-back c-channels 216 coupled to the side wall panel 111 sitting atop a concrete foundation 218 (e.g., the floor of a building) and having a crimped connecting panel 113 attached to its upper end. The illustrated side wall panel 111 has an upper section 156, a middle section 158 and a lower section 160. In one implementation, the upper section 156 is about 44 inches long, the middle section 158 is about 65 inches long and the lower section 160 is about 121 inches long. Of course, these dimensions can vary and various numbers of sections (including one section) may be used in various implementations. The illustrated sections 156, 158 and 160 are joined to each other by lap joints 220.

Figure 16B:
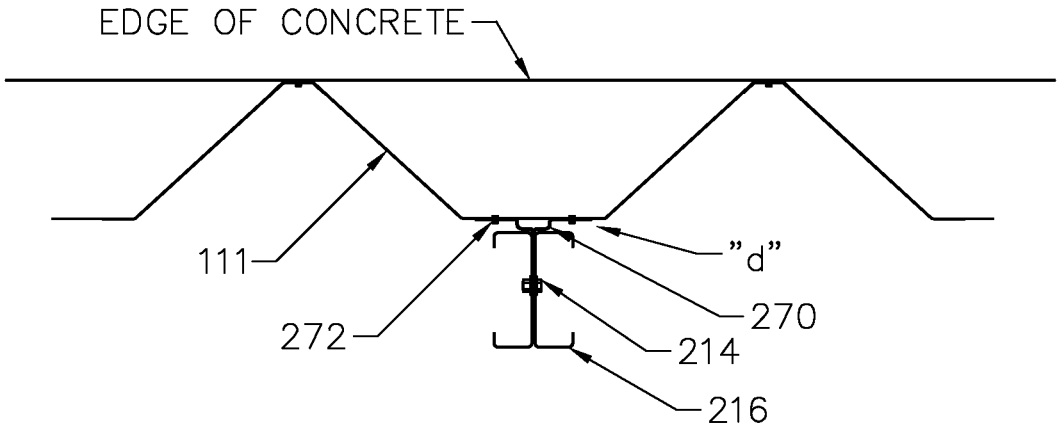
FIG. 16B is a schematic top view of a reinforced side wall panel.
Figure 16C:
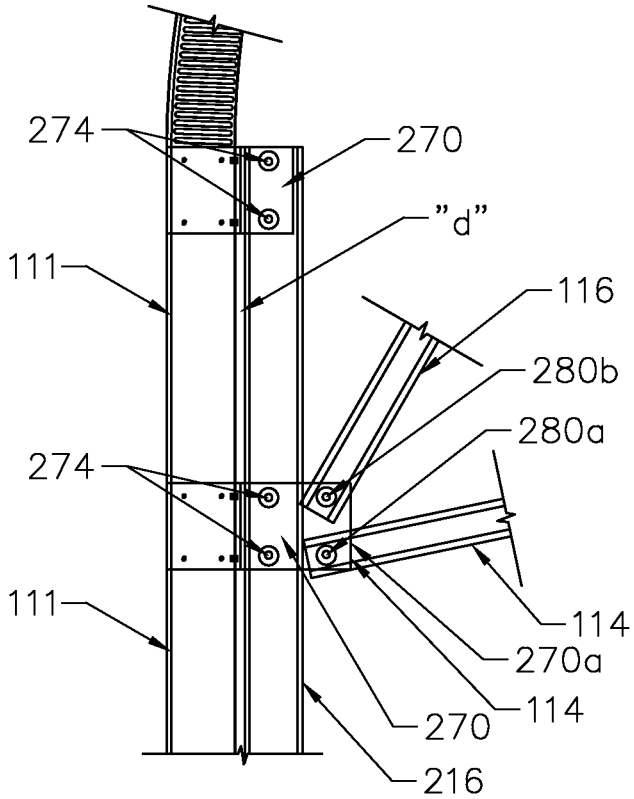
FIG. 16C is a side view of a reinforced side wall panel.

FIG. 16B and FIG. 16C show details about how, in an exemplary implementation, the back-to-back c-channels 216 are connected to the side wall panel 111. In the illustrated implementation, one or more clip arrangements 270 is bolted (e.g., at 272) or otherwise fastened to the side wall panel 111. Each clip arrangement 270 is configured so as to support the back-to-back c-channels at a distance "d" (e.g., about 1 inch) from the side wall panel 111. The clip arrangements 270 extend at least between the two back-to-back c-channels and one or more bolts are provided to secure the c-channels to the clip arrangement 270.

A portion 270*a* of the lower clip arrangement 270 in FIG. 16C extends beyond the back-to-back c-channels 216. The lower chord element 114 is connected to this extended portion 270*a* with a single bolt 280*a*. Likewise, web 116 is connected to the extended portion 270*a* of the lower clip arrangement 270 with a single bolt 280*b*.

Figure 17:
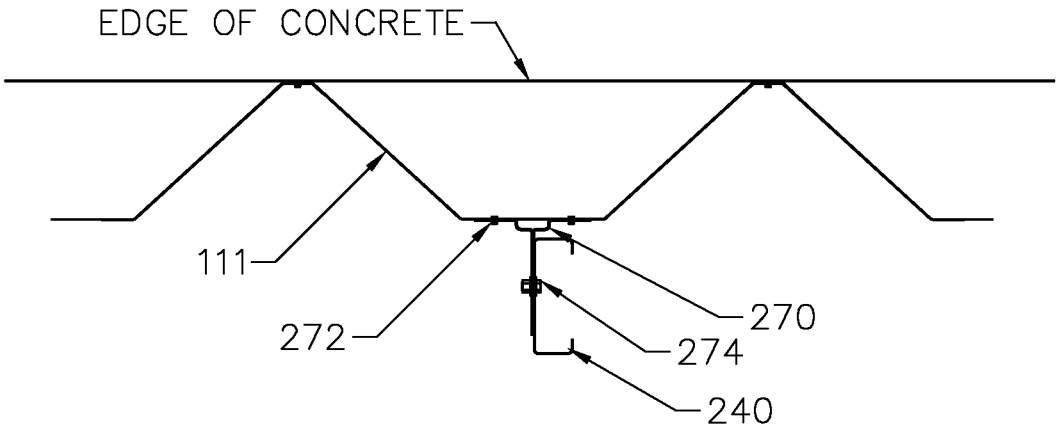
FIG. 17 is a schematic top view of a reinforced side wall panel.

FIG. 17 is similar to FIG. 16B, except that FIG. 17 shows details about how, in an exemplary implementation, a single c-channel 240 is connected to the side wall panel 111 to provide structural reinforcement to the side wall panel 111.

Although implementations of the structures and techniques disclosed herein enable roof spans to be very wide without the use of intermediate beams that extend vertically from the roof structure to the floor of the building, adding one or more such intermediate beams can extend the roof span even further. An example of such an intermediate beam 302 is shown in FIG. 18 and FIGS. 19A-19E.

Figure 18:
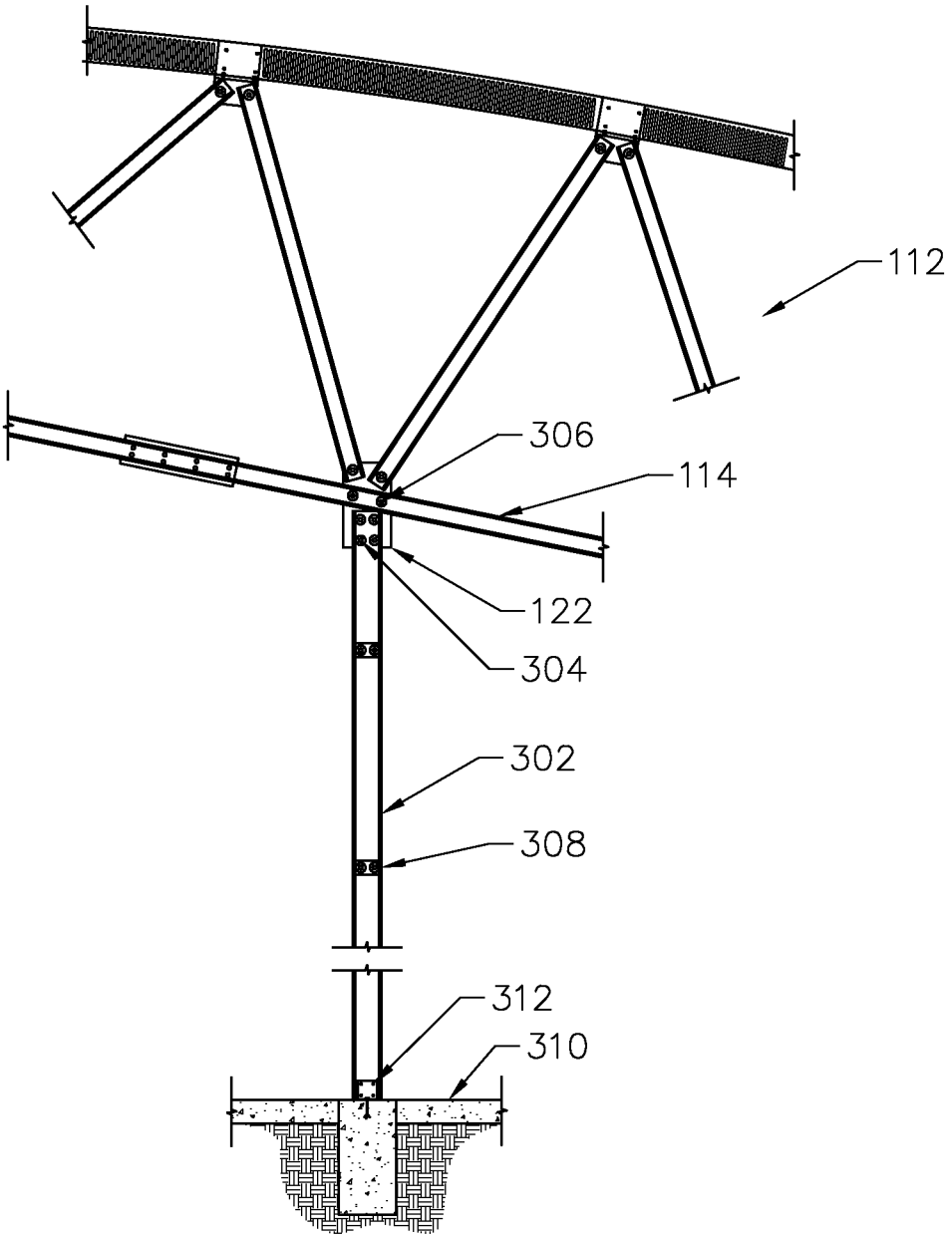
FIG. 18 is a perspective view of an intermediate structural beam.

The intermediate beam 302 shown in FIG. 18, for example, is coupled to the bottom chord 114 of the truss assembly 112 by a gusset plate 122. More particularly, the intermediate beam 302 is coupled to the gusset plate 122 by four bolts 304 and the gusset plate 122 is coupled to the bottom chord 114 of the truss assembly 112 by two bolts 306. The intermediate beam 302 can have any of a variety of possible profiles including, for example, a c-channel profile, a back-to-back c-channels profile, etc.

The intermediate beam 302 includes several sections that are coupled to one another with a small joint plate 308 at each joint. The intermediate beam 302 is coupled to the floor 310 (e.g., concrete slab) by a clip 312.

Figure 19A:
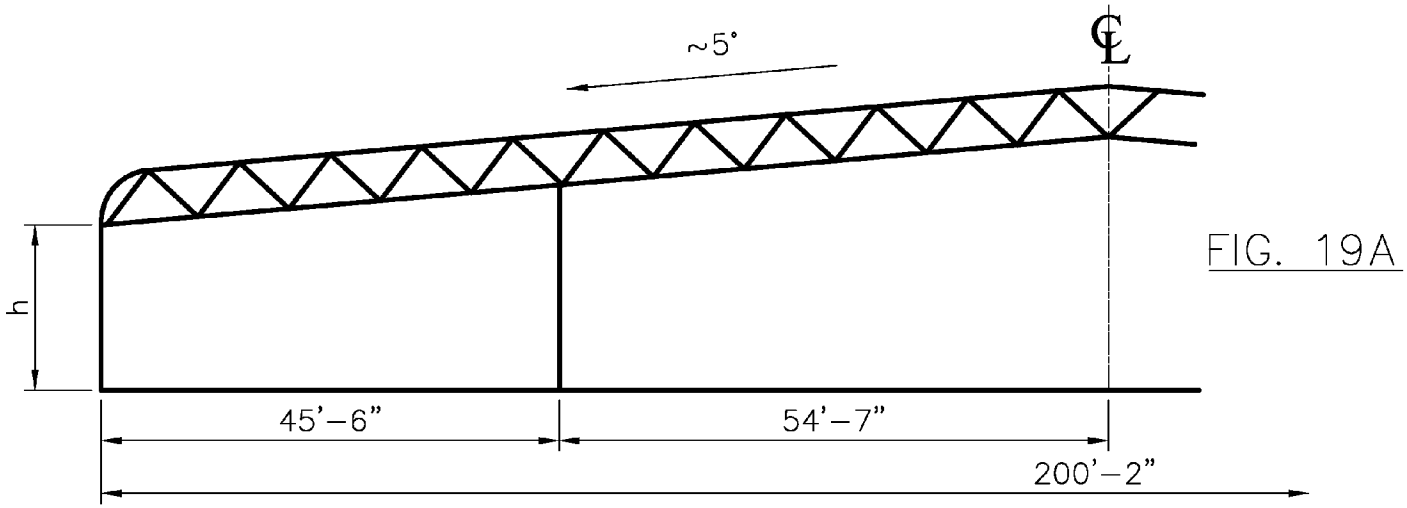
FIG. 19A-19E are schematic front views of a roof panel and a supporting truss assembly with intermediate columns.
Figure 19B:
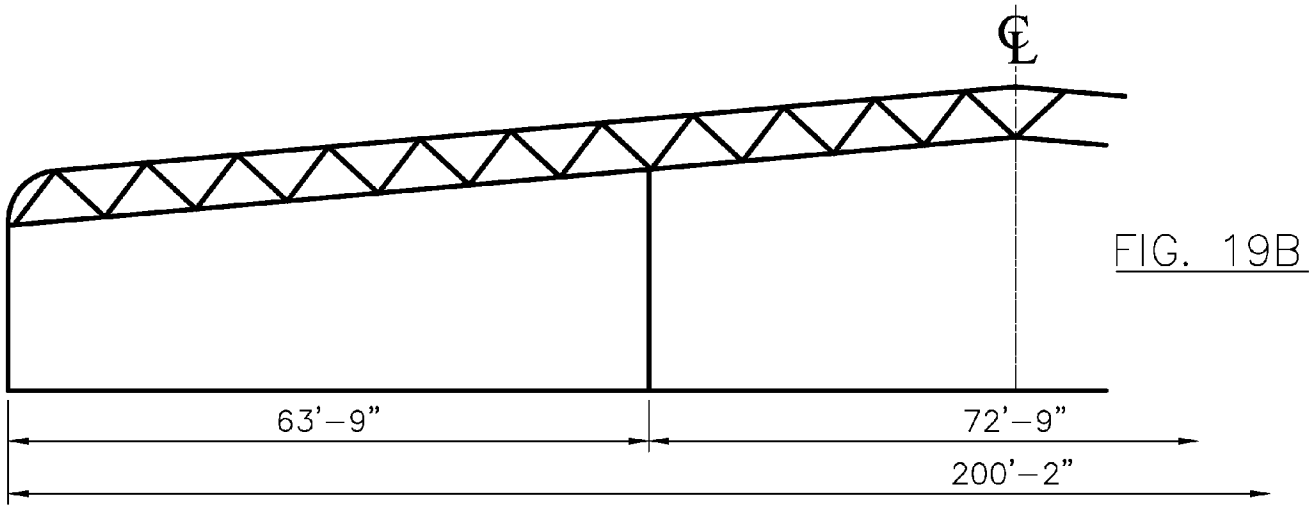
Figure 19C:
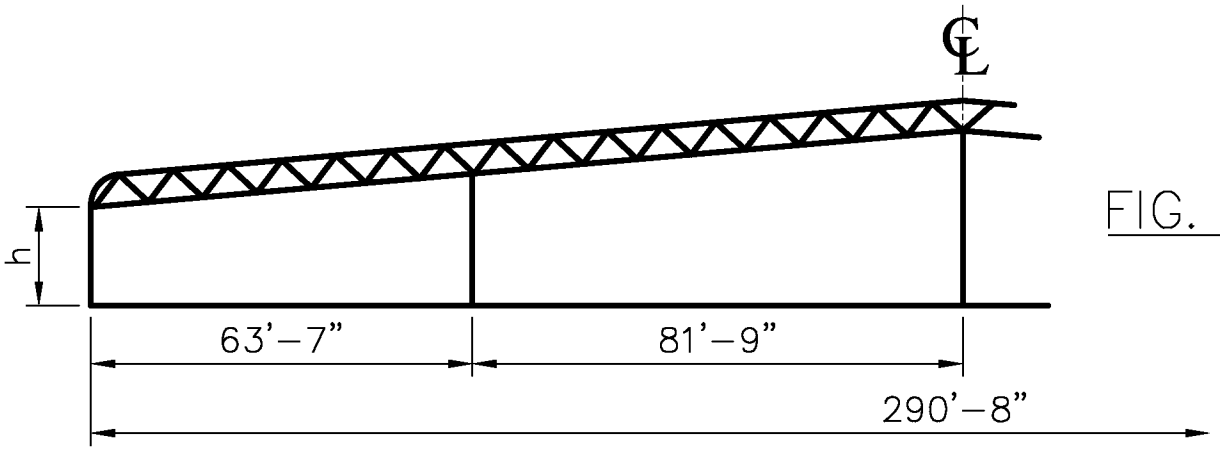
Figure 19D:
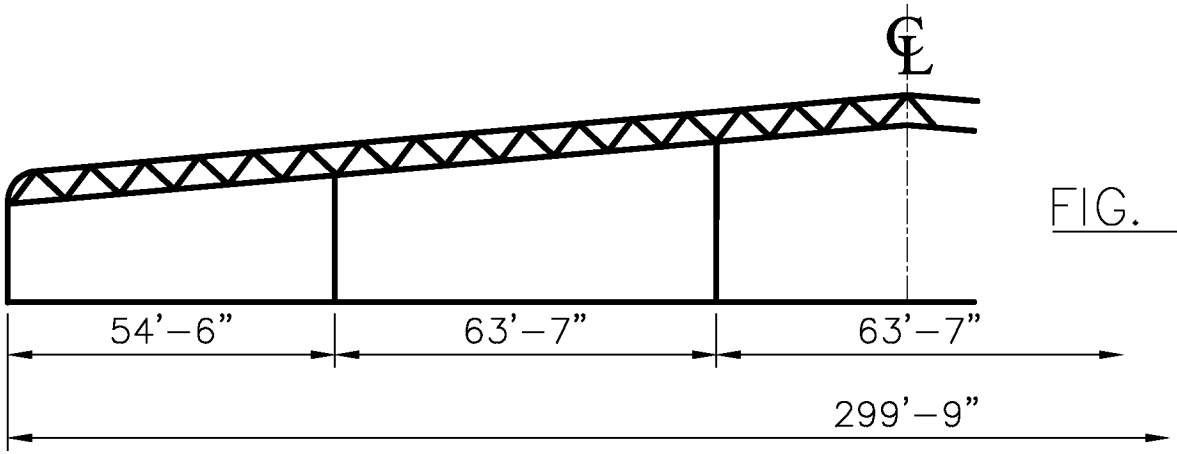
Figure 19E:
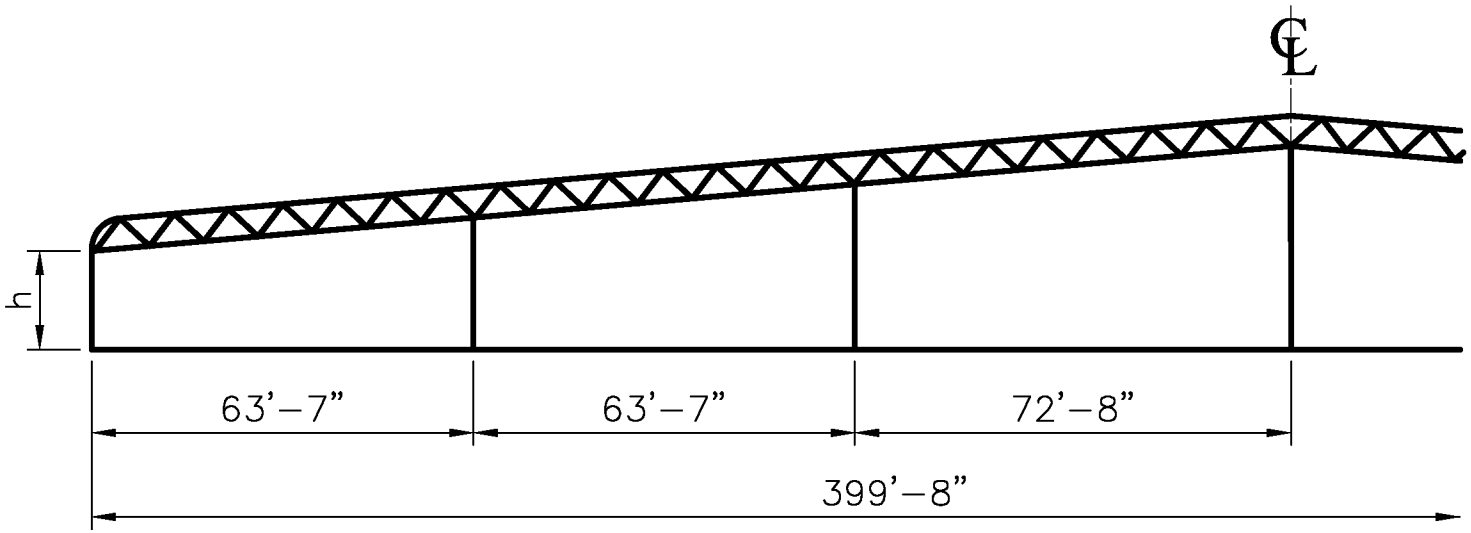

FIGS. 19A-19E show an example of the spacing between intermediate beams 302 in approximately 200-foot wide buildings (FIGS. 19A and 19B), approximately 300-foot wide buildings (FIGS. 19C and 19D) and approximately 400-foot wide buildings (FIG. 19E).

While a number of examples have been described for illustration purposes, the foregoing description is not intended to limit the scope of the invention, which is defined by the scope of the appended claims. There are and will be other examples and modifications within the scope of the following claims.

What is claimed is:

1. A building structure including a roof having an outer surface and comprising:

an upper chord element;

a lower beam;

a plurality of web elements aligned in a single row along the lower beam and extending between the upper chord element and the lower beam, the upper surface of the upper chord element forms an outer surface of the roof for the building structure and the upper chord element is configured to engage, in a substantially weather-proof manner, an adjacent structural element having a similar shape as the upper chord element, and wherein the upper chord element and the adjacent structural element cooperatively form a section of the outer surface of the roof for the building structure.

2. The building structure of claim 1 further comprising:

a first connecting panel connected to a first end of the upper chord element, wherein the first connecting panel is curved.

3. The building structure of claim 2 further comprising:

a first side wall panel connected to a first end of the first connecting panel and extending to a floor of the building structure, wherein the first side wall panel forms part of a first side wall of the building structure.

4. The building structure of claim 3 further comprising:
a second connecting panel connected to a second end of the upper chord element, wherein the second connecting panel is curved.

5. The building structure of claim 4 further comprising:
a second side wall panel connected to a second end of the second connecting panel and extending to the floor of the building structure,
wherein the second side wall panel forms part of a second side wall of the building structure.

6. The building structure of claim 5 wherein a distance between the first side wall panel and the second side wall panel is greater than 50 and less than 120 feet without intermediate structural elements that extend from the building structure to the floor between the first side wall panel and the second side wall panel.

7. The building structure of claim 5 wherein the first side wall panel and the second side wall panel extend from the first connecting panel and the second connecting panel, respectively, toward the floor at an outward angle relative to plumb.

8. The building structure of claim 7 wherein the outward angle is between about 8 degrees and 15 degrees.

9. The building structure of claim 3 further comprising:
a stiffening member coupled to the first side wall panel.

10. The building structure of claim 9 wherein the stiffening member is a structural element selected from the group consisting of a c-channel, an arrangement including back-to-back c-channels, an I-beam, a beam with a rectangular cross-section, a beam with an l-shaped cross-section, and an H-beam.

11. The building structure of claim 1 wherein the upper chord element comprises:
a substantially flat central segment;
a pair of inclined side segments that extend from opposite ends of the substantially flat central segment, respectively; and
a pair of flanges, wherein each flange extends from a distal end of one of the inclined side segments,
wherein the pair of flanges lie in a plane that is substantially horizontal to the substantially flat central segment.

12. The building structure of claim 11 wherein the upper chord element further comprises:
a pair of overhanging lips coupled to distal ends of each respective flange,
wherein each overhanging lip is angled relative to an adjacent one of the flanges in an opposite direction than a corresponding one of the inclined side walls.

13. The building structure of claim 3 wherein the upper chord element, the first connecting plate and the first side wall plate have substantially similar cross-sections and are joined to form a continuous structure.

14. The building structure of claim 1 wherein a distance across the upper chord element in a lateral direction is about 24.5 inches to about 49.0 inches.

15. The building structure of claim 1 further comprising:
a bracing system comprising a plurality of longitudinal stiffener members substantially parallel and coupled to the lower beam.

16. A building comprising:
a first building structure comprising:
an upper chord element;
a lower beam; and
a plurality of web elements aligned in a single row along the lower beam and extending between the upper chord element and the lower beam, and
a second building structure adjacent the first building structure, the second building structure comprising a structural element configured to engage the upper chord element of the first building structure in a substantially weatherproof manner,
wherein the upper chord element is configured to engage, in a substantially weather-proof manner, an adjacent structural element having a similar shape as the upper chord element, and the upper surface of the upper chord element of the first building structure and the structural element of the second building structure cooperatively form part of an outer surface of a roof for the building.

17. The building of claim 16 further comprising:
a first connecting panel and a second connecting panel,
the first connecting panel is connected to the upper chord element of the first building structure,
the second connecting panel is connected to the structural element of the second building structure,
wherein the first connecting panel and the second connecting panel are curved.

18. The building of claim 17 further comprising:
a first side wall panel connected to first connecting panel; and
a second side wall panel connected to the second connecting panel,
wherein the first side wall panel and the second side wall panel cooperatively form part of a first side wall of the building.

19. The building of claim 18 wherein the upper chord element of the first building structure is configured to engage, in a substantially weather-proof manner, the structural element of the second building structure,
wherein the structural element of the second building structure has a substantially similar shape as the upper chord element of the first building structure, and the upper chord element of the first building structure, and
the structural element of the second building structure cooperatively forms part of the outer surface of the roof for the building.

20. The building of claim 18 further comprising:
a third connecting panel connected to the upper chord element at an opposite end of the upper chord element from the first connecting panel; and
a fourth connecting panel connected to the structural element at an opposite end of the structural element from the second connecting panel,
wherein the third and fourth connecting panels are curved.

21. The building of claim 20 further comprising:
a third side wall panel connected to the third connecting panel; and
a fourth side wall panel connected to the fourth connecting panel,
wherein the third side wall panel and the fourth side wall panel cooperatively form part of a second side wall of the building.

22. The building of claim 21 wherein the first side wall panel and the second side wall panel are a distance from the third side wall panel and the fourth side wall panel that is greater than 50 feet and less than 120 feet without intermediate structural elements that extend from the building to the floor between the first side wall panel and the second side wall panel on one hand and the third side wall panel and the fourth side wall panel on another hand.

23. The building of claim 21 wherein the first side wall panel and the second side wall panel extend from the first connecting panel and the second connecting panel, respectively, toward the floor at a first outward angle relative to plumb and wherein the third side wall panel and the fourth side wall panel extend from the third connecting panel and the fourth connecting panel, respectively, toward the floor at a second outward angle relative to plumb.

24. The building of claim 23 wherein the first outward angle and the second outward angle are between about 8 degrees and 15 degrees.

25. The building of claim 20 further comprising:

a stiffening member coupled to one or more of the first side wall panel, the second side wall panel, the third side wall panel and the fourth side wall panel.

26. The building of claim 25 wherein the stiffening member is a structural element selected from the group consisting of a c-channel, an arrangement including back-to-back c-channels, an I-beam, a beam with a rectangular cross-section, a beam with an l-shaped cross-section, and an H-beam.

27. The building of claim 16 wherein each of the upper chord element and the structural element comprises:

a substantially flat central segment;

a pair of inclined side walls that extend from opposite ends of the substantially flat central segment, respectively; and a pair of flanges, wherein each flange extends from a distal end of one of the inclined side walls, wherein the pair of flanges lie in a plane that is substantially horizontal to the substantially flat central segment.

28. The building of claim 27 wherein each of the upper chord element and structural element further comprises:

a pair of overhanging lips coupled to distal ends of each respective flange, wherein each overhanging lip is angled relative to an adjacent one of the flanges in an opposite direction than a corresponding one of the inclined side walls.

29. The building of claim 27 wherein each of the upper chord element, a first connecting plate, a third connecting plate, a first side wall plate and a third side wall plate have substantially similar cross-sections and are joined to form a continuous structure; and wherein each of the structural element, a second connecting plate, a fourth connecting plate, a second side wall plate and a fourth side wall plate have substantially similar cross-sections and are joined to form a continuous structure.

30. The building of claim 16 further comprising:

a bracing system comprising a plurality of longitudinal stiffener members substantially parallel and coupled to the lower beam.

31. A building structure comprising:

an upper chord element which comprises:

a substantially flat central segment;

a pair of inclined side segments that extend from opposite ends of the substantially flat central segment, respectively; and a pair of flanges, wherein each flange extends from a distal end of one of the inclined side segments, wherein the pair of flanges lie in a plane that is substantially horizontal to the substantially flat central segment, a lower chord element;

a plurality of web elements extending between the upper chord element and the lower chord element, wherein the upper chord element forms part of an outer surface of a roof for the building structure and further comprises a stiffening channel in the substantially flat central segment, wherein the stiffening channel has a width between about 0.75 inches and about 1.25 inches, and wherein the stiffening channel has a depth between about 0.25 inches and about 0.375 inches.

32. A building structure comprising:

an upper chord element which comprises a substantially flat central segment;

a pair of inclined side segments that extend from opposite ends of the substantially flat central segment, respectively; and a pair of flanges, wherein each flange extends from a distal end of one of the inclined side segments, the pair of flanges lying in a plane that is substantially horizontal to the substantially flat central segment, a lower chord element;

a plurality of web elements aligned in a single row along the lower beam and extending between the upper chord element and the lower chord element and, the upper chord element forms part of an outer surface of a roof for the building structure and wherein the upper chord element further comprises:

a pair of overhanging lips coupled to distal ends of each respective flange and each overhanging lip is angled relative to an adjacent one of the flanges in an opposite direction than a corresponding one of the inclined side walls.

33. A building comprising:

a first building structure comprising:

an upper chord element;

a lower chord element; and a plurality of web elements extending between the upper chord element and the lower chord element, and a second building structure adjacent the first building structure, the second building structure comprising a structural element configured to engage the upper chord element of the first building structure in a substantially weatherproof manner, wherein the upper chord element of the first building structure and the structural element of the second building structure cooperatively form part of an outer surface of a roof for the building, each of the upper chord element and the structural element comprises:

a substantially flat central segment;

a pair of inclined side walls that extend from opposite ends of the substantially flat central segment, respectively; and a pair of flanges, wherein each flange extends from a distal end of one of the inclined side walls, the pair of flanges lying in a plane that is substantially horizontal to the substantially flat central segment each of the upper chord element and the structural element further comprises a stiffening channel in the substantially flat central segment, wherein the stiffening channel has a width between about 0.75 inches and about 1.25 inches, and wherein the stiffening channel has a depth between about 0.25 inches and about 0.375 inches.

34. A building comprising:

a first building structure comprising:

an upper chord element;

a lower chord element; and a plurality of web elements aligned in a single row along the lower beam and extending between the upper chord element and the lower chord element, and a second building structure adjacent the first building structure, the second building structure comprising a structural element configured to engage the upper chord element of the first building structure in a substantially weatherproof manner, wherein the upper chord element of the first building structure and the structural element of the second building structure cooperatively form part of an outer surface of a roof for the building, each of the upper chord element and the structural element comprises:

a substantially flat central segment;

a pair of inclined side walls that extend from opposite ends of the substantially flat central segment, respectively; and a pair of flanges, each flange extending from a distal end of one of the inclined side walls, and wherein the pair of flanges lie in a plane that is substantially horizontal to the substantially flat central segment and wherein each of the upper chord element and structural element further comprises:

a pair of overhanging lips coupled to distal ends of each respective flange, wherein each overhanging lip is angled relative to an adjacent one of the flanges in an opposite direction than a corresponding one of the inclined side walls.

35. The building structure of claim 1 wherein the upper chord has a continuous upper surface.

36. A building structure including a roof having an outer surface and comprising:

an upper chord element which comprises:

a substantially flat central segment;

a pair of inclined side segments that extend from opposite ends of the substantially flat central segment, respectively, a pair of flanges, wherein each flange extends from a distal end of one of the inclined side segments, a lower chord element;

a plurality of web elements extending between the upper chord element and the lower chord element, wherein the upper surface of the upper chord element forms an outer surface of the roof for the building structure and the upper chord element is configured to engage, in a substantially weather-proof manner, an adjacent structural element having a similar shape as the upper chord element, the upper chord element and the adjacent structural element cooperatively form a section of the outer surface of the roof for the building structure, the pair of flanges lie in a plane that is substantially horizontal to the substantially flat central segment and the upper chord element further comprises:

a stiffening channel in the substantially flat central segment, wherein the stiffening channel has a width between about 0.75 inches and about 1.25 inches, and wherein the stiffening channel has a depth between about 0.25 inches and about 0.375 inches.

37. A building structure including a roof having an outer surface and comprising:

an upper chord element;

a lower chord element;

a plurality of web elements aligned in a single row along the lower beam and extending between the upper chord element and the lower chord element, wherein the upper surface of the upper chord element forms an outer surface of the roof for the building structure and the upper chord element is configured to engage, in a substantially weather-proof manner, an adjacent structural element having a similar shape as the upper chord element, and wherein the upper chord element and the adjacent structural element cooperatively form a section of the outer surface of the roof for the building structure, the upper chord element comprises a substantially flat central segment; a pair of inclined side segments that extend from opposite ends of the substantially flat central segment, respectively; and a pair of flanges, wherein each flange extends from a distal end of one of the inclined side segments, the pair of flanges lie in a plane that is substantially horizontal to the substantially flat central segment and wherein the upper chord element further comprises a pair of overhanging lips coupled to distal ends of each respective flange, wherein each overhanging lip is angled relative to an adjacent edge of the flanges in an opposite direction than a corresponding one of the inclined side walls.

38. A building comprising:

a first building structure comprising:

an upper chord element;

a lower chord element; and a plurality of web elements extending between the upper chord element and the lower chord element, and a second building structure adjacent the first building structure, the second building structure comprising a structural element configured to engage the upper chord element of the first building structure in a substantially weatherproof manner, wherein the upper chord element is configured to engage, in a substantially weather-proof manner, an adjacent structural element having a similar shape as the upper chord element, and the upper surface of the upper chord element of the first building structure and the structural element of the second building structure cooperatively form part of an outer surface of a roof for the building, each of the upper chord element and the structural element comprises a substantially flat central segment;

a pair of inclined side walls that extend from opposite ends of the substantially flat central segment, respectively;

and a pair of flanges, each of the flanges extends from a distal end of one of the inclined side walls, the pair of flanges lie in a plane that is substantially horizontal to the substantially flat central segment and each of the upper chord element and the structural element further comprises a stiffening channel in the substantially flat central segment, wherein the stiffening channel has a width between about 0.75 inches and about 1.25 inches, and wherein the stiffening channel has a depth between about 0.25 inches and about 0.375 inches.

39. A building comprising:

a first building structure comprising:

an upper chord element;

a lower beam;

and a plurality of web elements aligned in a single row along the lower beam and extending between the upper chord element and the lower beam, a second building structure adjacent the first building structure, the second building structure comprising a structural element configured to engage the upper chord element of the first building structure in a substantially weatherproof manner, the upper chord element is configured to engage, in a substantially weather-proof manner, an adjacent structural element having a similar shape as the upper chord element, and the upper surface of the upper chord element of the first building structure and the structural element of the second building structure cooperatively form part of an outer surface of a roof for the building, each of the upper chord element and the structural element comprises:

a substantially flat central segment;

a pair of inclined side walls that extend from opposite ends of the substantially flat central segment, respectively;

and a pair of flanges, wherein each flange extends from a distal end of one of the inclined side walls, and the pair of flanges lie in a plane that is substantially horizontal to the substantially flat central segment, and wherein each of the upper chord element and structural element further comprises:

a pair of overhanging lips coupled to distal ends of each respective flange, wherein each overhanging lip is angled relative to an adjacent one of the flanges in an opposite direction than a corresponding one of the inclined side walls.

40. A building comprising:

a first building structure comprising:

an upper chord element;

a lower chord element; and a plurality of web elements extending between the upper chord element and the lower chord element, a second building structure adjacent the first building structure, the second building structure comprising a structural element configured to engage the upper chord element of the first building structure in a substantially weatherproof manner, the upper chord element is configured to engage, in a substantially weather-proof manner, an adjacent structural element having a similar shape as the upper chord element, and the upper surface of the upper chord element of the first building structure and the structural element of the second building structure cooperatively form part of an outer surface of a roof for the building, each of the upper chord element and the structural element comprises:

a substantially flat central segment;

a pair of inclined side walls that extend from opposite ends of the substantially flat central segment, respectively; and a pair of flanges, wherein each flange extends from a distal end of one of the inclined side walls, and the pair of flanges lie in a plane that is substantially horizontal to the substantially flat central segment and further comprising:

a spacer member connected between one of the flanges of the upper chord element and one of the flanges of the structural element.

41. A building structure including a roof having an outer surface and comprising:

an upper chord element;

a lower beam;

a plurality of web elements extending between the upper chord element and the lower beam, the upper surface of the upper chord element forms an outer surface of the roof for the building structure and the upper chord element is configured to engage, in a substantially weather-proof manner, an adjacent structural element having a similar shape as the upper chord element, and wherein the upper chord element and the adjacent structural element cooperatively form a section of the outer surface of the roof for the building structure and wherein the upper chord element comprises:

a substantially flat central segment;

a pair of inclined side segments that extend from opposite ends of the substantially flat central segment, respectively; and a pair of flanges, wherein each flange extends from a distal end of one of the inclined side segments, wherein the pair of flanges lie in a plane that is substantially horizontal to the substantially flat central segment and a stiffening channel in the substantially flat central segment, wherein the stiffening channel has a width between about 0.75 inches and about 1.25 inches, and wherein the stiffening channel has a depth between about 0.25 inches and about 0.375 inches.

42. A building structure including a roof having an outer surface and comprising:

an upper chord element;

a lower beam;

a plurality of web elements extending between the upper chord element and the lower beam, the upper surface of the upper chord element forms an outer surface of the roof for the building structure and the upper chord element is configured to engage, in a substantially weather-proof manner, an adjacent structural element having a similar shape as the upper chord element, and wherein the upper chord element and the adjacent structural element cooperatively form a section of the outer surface of the roof for the building structure and wherein the plurality of web elements comprises diagonal members and one or more members that extend from a point on the upper chord element along a shortest path to the lower beam.

43. A building comprising:

a first building structure comprising:

an upper chord element;

a lower beam; and a plurality of web elements extending between the upper chord element and the lower beam, and a second building structure adjacent the first building structure, the second building structure comprising a structural element configured to engage the upper chord element of the first building structure in a substantially weatherproof manner, wherein the upper chord element is configured to engage, in a substantially weather-proof manner, an adjacent structural element having a similar shape as the upper chord element, and the upper surface of the upper chord element of the first building structure and the structural element of the second building structure cooperatively form part of an outer surface of a roof for the building and wherein each of the upper chord element and the structural element comprises:

a substantially flat central segment;

a pair of inclined side walls that extend from opposite ends of the substantially flat central segment, respectively; and a pair of flanges, wherein each flange extends from a distal end of one of the inclined side walls, wherein the pair of flanges lie in a plane that is substantially horizontal to the substantially flat central segment and each of the upper chord element and the structural element further comprises:

a stiffening channel in the substantially flat central segment, wherein the stiffening channel has a width between about 0.75 inches and about 1.25 inches, and wherein the stiffening channel has a depth between about 0.25 inches and about 0.375 inches.

44. A building comprising:

a first building structure comprising:

an upper chord element;

a lower beam; and a plurality of web elements extending between the upper chord element and the lower beam, and a second building structure adjacent the first building structure, the second building structure comprising a structural element configured to engage the upper chord element of the first building structure in a substantially weatherproof manner, wherein the upper chord element is configured to engage, in a substantially weather-proof manner, an adjacent structural element having a similar shape as the upper chord element, and the upper surface of the upper chord element of the first building structure and the structural element of the second building structure cooperatively form part of an outer surface of a roof for the building and wherein each of the upper chord element and the structural element comprises:

a substantially flat central segment;

a pair of inclined side walls that extend from opposite ends of the substantially flat central segment, respectively; and a pair of flanges, wherein each flange extends from a distal end of one of the inclined side walls, wherein the pair of flanges lie in a plane that is substantially horizontal to the substantially flat central segment and further comprising:

a spacer member connected between one of the flanges of the upper chord element and one of the flanges of the structural element.

45. A building comprising:

a first building structure comprising:

an upper chord element;

a lower beam; and a plurality of web elements extending between the upper chord element and the lower beam, and a second building structure adjacent the first building structure, the second building structure comprising a structural element configured to engage the upper chord element of the first building structure in a substantially weatherproof manner, wherein the upper chord element is configured to engage, in a substantially weather-proof manner, an adjacent structural element having a similar shape as the upper chord element, and the upper surface of the upper chord element of the first building structure and the structural element of the second building structure cooperatively form part of an outer surface of a roof for the building and wherein the plurality of web elements comprises diagonal members and one or more members that extend from a point on the upper chord element along a shortest path to the lower beam.

* * * * *